US006633238B2

(12) United States Patent
Lemelson et al.

(10) Patent No.: US 6,633,238 B2
(45) **Date of Patent: *Oct. 14, 2003**

(54) INTELLIGENT TRAFFIC CONTROL AND WARNING SYSTEM AND METHOD

(76) Inventors: Jerome H. Lemelson, deceased, late of Incline Village, NV (US), by Dorothy Lemelson, executor, Unit 802, Suite 286, 930 Tahoe Blvd. Incline Village, NV 89451; Robert D. Pedersen, 7808 Gleneagle Dr., Dallas, TX (US) 75248; Steven R. Pedersen, 7808 Gleneagle Dr., Dallas, TX (US) 75248

( * ) Notice: Subject to any disclaimer, the term of this patent is extended or adjusted under 35 U.S.C. 154(b) by 0 days.

This patent is subject to a terminal disclaimer.

(21) Appl. No.: 09/871,482

(22) Filed: May 31, 2001

(65) Prior Publication Data

US 2002/0008637 A1 Jan. 24, 2002

Related U.S. Application Data

(63) Continuation of application No. 09/397,296, filed on Sep. 15, 1999, now Pat. No. 6,317,058.

(51) Int. Cl.[7] ..... G08G 1/07

(52) U.S. Cl. ..... 340/909; 340/910; 340/905; 340/906; 340/914; 340/917

(58) Field of Search ..... 340/910, 906, 340/909, 905, 911, 914, 917, 924; 701/117

(56) References Cited

U.S. PATENT DOCUMENTS

| | | | | |
|---|---|---|---|---|
| 3,879,004 | A | 4/1975 | Andreasen | 246/62 |
| 3,886,515 | A | 5/1975 | Cottin et al. | 340/23 |
| RE28,852 | E | 6/1976 | Sproul, Sr. | 340/107 |
| 3,991,485 | A | 11/1976 | Golenski | 35/11 |
| 4,051,524 | A | 9/1977 | Baxter | 358/108 |
| 4,173,010 | A | 10/1979 | Hoffmann | 340/31 |
| 4,200,860 | A | 4/1980 | Fritzinger | 340/43 |
| 4,228,419 | A | 10/1980 | Anderson | 340/32 |
| 4,237,483 | A | 12/1980 | Clever | 358/108 |
| 4,317,117 | A | 2/1982 | Chasek | 343/6 ND |
| 4,322,801 | A | 3/1982 | Williamson et al. | 364/436 |
| 4,352,086 | A | 9/1982 | Hunziker | 340/35 |

(List continued on next page.)

FOREIGN PATENT DOCUMENTS

| | | |
|---|---|---|
| BR | 80/000009 | 6/1980 |
| DE | 2 411 716 | 3/1974 |
| DE | 27 39 863 | 9/1977 |
| FR | 2 562 694 | 10/1985 |
| JP | 3-157799 | 7/1991 |
| JP | 4-148299 | 5/1992 |

OTHER PUBLICATIONS

Howell, Curtis; "Zoom Lenses: Cameras Help DOT Keep Things Moving," *The Dallas Morning News*, p 10A (May 18, 1998).

"Traffic Control System Uses Laser Communication Link," *Computer Design*, vol. 18, No. 3 (Mar. 1979).

(List continued on next page.)

*Primary Examiner*—Daryl Pope
(74) *Attorney, Agent, or Firm*—Steven G. Lisa; Douglas W. Rudy

(57) ABSTRACT

A system and method for controlling traffic and traffic lights and selectively distributing warning messages to motorists includes a controller to determine appropriate action based on traffic congestion parameters. Fuzzy logic is used to determine optimum traffic light phase split based on the traffic information from the traffic information units. Global Positioning System technology is used by the system and method in order to track moving vehicles and signs and be able to communicate with them.

20 Claims, 13 Drawing Sheets

U.S. PATENT DOCUMENTS

| | | | | |
|---|---|---|---|---|
| 4,370,718 | A | 1/1983 | Chasek | 364/436 |
| 4,398,171 | A | 8/1983 | Dahan et al. | 340/22 |
| 4,704,610 | A | 11/1987 | Smith et al. | 340/906 |
| 4,775,865 | A | 10/1988 | Smith et al. | 340/906 |
| 4,908,615 | A | 3/1990 | Bayraktarouglu | 340/917 |
| 4,914,434 | A | 4/1990 | Morgan et al. | 340/906 |
| 4,926,163 | A | 5/1990 | Beebe | 340/581 |
| 4,956,632 | A | 9/1990 | Perrigo | 340/463 |
| 4,985,705 | A | 1/1991 | Stammler | 342/69 |
| 5,010,319 | A | 4/1991 | Killinger | 340/472 |
| 5,041,828 | A | 8/1991 | Loeven | 340/937 |
| 5,161,107 | A | 11/1992 | Mayeaux | 364/436 |
| 5,164,904 | A | 11/1992 | Sumner | 364/436 |
| 5,182,555 | A | 1/1993 | Sumner | 340/905 |
| 5,206,641 | A | 4/1993 | Grant et al. | 340/905 |
| 5,214,793 | A | 5/1993 | Conway et al. | 455/49.1 |
| 5,257,023 | A | 10/1993 | Furuya | 340/995 |
| 5,257,194 | A | 10/1993 | Sakita | 364/436 |
| 5,270,708 | A | 12/1993 | Kamishima | 340/995 |
| 5,294,924 | A | 3/1994 | Dydzyk | 340/908 |
| 5,313,200 | A | 5/1994 | Sone | 340/905 |
| 5,317,311 | A | 5/1994 | Martelo et al. | 340/905 |
| 5,357,436 | A | 10/1994 | Chiu | 364/436 |
| 5,396,429 | A | 3/1995 | Hanchett | 364/436 |
| 5,432,547 | A | 7/1995 | Toyama | 348/149 |
| 5,444,442 | A | 8/1995 | Sadakata et al. | 340/916 |
| 5,448,219 | A | 9/1995 | Yoshikawa et al. | 340/436 |
| 5,459,665 | A | 10/1995 | Hikita et al. | 364/437 |
| 5,493,291 | A | 2/1996 | Brüggemann | 340/905 |
| 5,504,488 | A | 4/1996 | Henderson | 342/115 |
| 5,572,202 | A | 11/1996 | Regel et al. | 340/917 |
| 5,652,705 | A | 7/1997 | Spiess | 364/436 |
| 5,668,717 | A | 9/1997 | Spall | 364/148 |
| 5,696,502 | A | 12/1997 | Busch et al. | 340/905 |
| 5,699,056 | A | 12/1997 | Yoshida | 340/905 |
| 5,729,214 | A | 3/1998 | Moore | 340/905 |
| 5,732,383 | A | 3/1998 | Foladare et al. | 701/117 |
| 5,734,337 | A | 3/1998 | Kupersmit | 340/937 |
| 5,771,484 | A | 6/1998 | Tognazzini | 701/117 |

OTHER PUBLICATIONS

Krigman, "Computerizing Traffic Control," *Instruments and Control Systems,* (Jun. 1972).

Gosch, "Europe Gets 'Thinking' Traffic Lights," *Electronics*, (May 1975).

"Microcomputerized Traffice Analyzer Guides Faithful in Moslem Pilgrimmage," *Digital Design,*(Feb. 1977).

Brinkman, "Application of the All–Purpose Traffic Processor," *Phillips Telecommunication Review*, vol. 33, No. 11 (Mar. 1975).

"Image Sensing Systems . . . The Company Behind Autoscope," *Image Sensing System, Inc.–Home Page* (May 27, 1998).

"Priority One gps Traffic Preemption System," *MTP Priority One GPS Traffice Preemeption System: Home Page* (May 13, 1998).

Fenton, Robert E., "On Future Traffic Control: Advanced Systems Hardware," *IEEE Transactions on Vehicular Technology*, pp. 200–207 (vol. VT–29, No. 2, May 1980).

Belohoubek, "Radar Control for Automotive Collision Mitigation and Headway Spacing," *IEEE Transactions on Vehicular Technology*, pp. 89–99 (vol. Vt–31, No. 2, May 1982).

Hatwal et al., "Some Inverse Solutions to an Automobile Path–Tracking Problem with Input Control of Steering and Brakes," *IEEE Transactions on Vehicular Technology*, (Vol. VT–31, No. 2, May 1982).

Bender, "An Overview of Systems Studies of Automated Highway Systems," *IEEE Transactions on Vehicular Technology*, pp. 82–99 (vol. 40, No. 1, Feb. 1991).

Altan et al., "Computer Architecture and Implementation of Vision–Based Real–Time Lane Sensing," *IEEE Intelligent Vehicles Symposium*, pp. 202–206 (Jul. 1992).

Hatsopoulos et al., "Collision–Avoidance System Based on Optical Flow," *IEEE Intelligent Vehicles Symposium*, pp.79–84 (Jul. 1992).

Siegle et al., "Autonomous Driving on a Road Network," *IEEE Intelligent Vehicles Symposium*, pp. 403–404 (Jul. 1992).

Lubin et al., "Lateral Control of an Autonomous Road Vehicle in a Simulated Highway Enviroment Using Adaptive Resonance Neural Networks," *IEEE Intelligent Vehicles Symposium*, pp. 85–91 (Jul. 1992).

Pomerleau, "Progress in Neural Network–Based Vision for Autonomous Robot Driving," *IEEE Intelligent Vehicles Symposium*, pp. 391–396 (Jul. 1992).

Riseman, "Visual Processing for Vehicle Control Functions," *IEEE Intelligent Vehicles Symposium*, pp. 397–402 (Jul. 1992).

Ulmer, "Vita—An Autonomous Road Vehicle (ARV) for Collision Avoidance in Traffic," *IEEE Intelligent Vehicles Symposium*, pp. 36–41 (Jul. 1992).

Kim et al., "The Areawide Real–Time Traffic Control (ARTC) System: A New Traffic Control Concept," *IEEE Transaction on Vehicular Technology*, pp. 212–224 (vol. 42, No.2, May 1993).

Kamat et al., "Hough Transform for Vehicle Identification," *IEEE Intelligent Vehicles Symposium*, pp. 230–234 (Jul. 1993).

Liu et al., "Real–time Neural Vision for Vehicle Navigation and Safety," *IEEE Intelligent Vehicles Sysposium*, pp. 283–286 (Jul. 1993).

Mertsching et al., "Interpretation of Traffic Scenes Using a Hierarchical Data Structure," *IEEE Intelligent Vehicles Symposium*, pp. 163–168 (Jul. 1993).

Pomerleau, "Neural Networks for Intelligent Vehicles," *IEEE Intelligent Vehicles Symposium*, pp. 19–24 (Jul. 1993).

Romano et al., "A Real–Time Visual Reflex for Autonomous Navigation," *IEEE Intelligent Vehicles Symposium*, pp. 50–55 (Jul. 1993).

Hughes, "Aerospace Electronics May Guide Smart Cars," *Aviation Week & Space Technology*, p.63–64 (Nov. 1993).

TE=L; TW=L
NO OUTSIDE FACTORS

TE=M; TW=L
NO OUTSIDE FACTORS

TE=H; TW=L
NO OUTSIDE FACTORS

TE=L; TW=M
NO OUTSIDE FACTORS

TE=M; TW=M
NO OUTSIDE FACTORS

TE=H; TW=M
NO OUTSIDE FACTORS

TE=L; TW=H
NO OUTSIDE FACTORS

TE=M; TW=H
NO OUTSIDE FACTORS

TE=H; TW=H
NO OUTSIDE FACTORS

LEGEND:

| | |
|---|---|
| L = LOW | S = SHORT |
| M = MEDIUM | N = NORMAL |
| H = HIGH | L = LONG |

| GPS COORDINATES | WARNING MESSAGE |
|---|---|
| INTERSECTION 1 | ACCIDENT |
| INTERSECTION 4 | HEAVY NS TRAFFIC |
| INTERSECTION 13 | TRAFFIC LIGHTS MALFUNCTIONING |
| INTERSECTION 14 | HEAVY EW TRAFFIC |
| INTERSECTION 20 | CHEMICAL HAZARD |

FIG. 11

AVOIDANCE LEVEL

DISTANCE TO DANGEROUS SITUATION

| | LOW | MEDIUM | HIGH |
|---|---|---|---|
| LOW | M | M | H |
| MEDIUM | L | M | H |
| HIGH | L | L | M |

INTELLIGENT TRAFFIC CONTROL AND WARNING SYSTEM AND METHOD

CROSS REFERENCE TO RELATED APPLICATIONS

This application is a continuation of application Ser. No. 09/397,296, filed Sep. 15, 1999 now U.S. Pat. No. 6,317,058.

FIELD OF INVENTION

These inventions relate to traffic control and warning systems, and, in particular, to traffic control and warning systems that incorporate the use of fuzzy logic or other expert systems.

BACKGROUND

Present methods of controlling traffic are in need of improvement. One area needing improvement is the method of controlling traffic lights. A significant amount of time is wasted while waiting for a traffic light to turn green. Motorists are oftentimes forced to wait at a red light while there is little or no cross traffic. This type of situation often causes drivers to become very impatient or frustrated. Angry and frustrated drivers are dangerous and are more prone to cause accidents. People not only waste precious time while waiting for traffic lights to turn green but also while sitting idle in traffic congestion or traffic jams. Again, these situations cause certain drivers to become very angry and frustrated.

Traffic flow can also be improved by providing motorists with real time, relevant traffic information. Many times, traffic information is available via local radio stations. Radio stations do not, however, necessarily provide real time information. Thus, motorists often find themselves caught in a traffic jam before the radio station is able to inform them of the traffic situation. Moreover, the current traffic information provided by local radio stations may not be relevant for some specific drivers, particularly drivers at different geographic locations or headed in different directions. Also, the radio traffic reports are generally for commuters who travel via freeways or highways and are generally not for drivers in neighborhoods and on smaller/local streets and roads. The lack of localized traffic information prevents motorists from avoiding local traffic jams or congestion areas that are not reported by the radio stations. Therefore, improved methods of controlling traffic lights and providing real time, relevant traffic information to motorists based on their location and travel direction are needed and desired.

Present traffic warning signs are confined to freeway applications. Such signs do not use fuzzy logic or expert systems analysis with real time updates based on traffic light phase splits, real time traffic analysis, or GPS based location calculations of sign and traffic congestion or locations of other problems. Present systems also do not use portable signs with GPS receivers to calculate locations and then use the calculated locations in determination of information to be displayed.

Furthermore, there is a need for traffic control and warning systems and methods that optimize traffic flow based on traffic patterns and other factors. There is a need to integrate control information into comprehensive motor vehicle warning systems and methods that warn or advise drivers of situations that should be avoided.

The present invention uses fuzzy logic or expert system algorithms and GPS technology to provide an improved, integrated system and method for controlling traffic lights and traffic flow and to provide current, real time, up-to-date, relevant traffic information to motorists.

Several prior art patents address different aspects of traffic control and warning systems. For example, it is known to compile and evaluate local traffic data via radar. See, e.g., U.S. Pat. Nos. 4,985,705; 5,041,828; 4,908,615.

It is also known to use cameras to monitor traffic violations and record traffic statistics. See, e.g., U.S. Pat. Nos. 5,432,547; 5,041,828; 5,734,337.

It is also known to detect vehicles approaching an intersection. Furthermore, it is known to warn motorists at intersections of approaching vehicles. See, e.g., U.S. Pat. Nos. 5,448,219; 5,572,202, and French Patent No. 2562-694-A.

It is also known to modify traffic control information via circuit arrangements. See, e.g., U.S. Pat. No. 4,352,086.

It is also known to control traffic lights based on the conservation of aggregate momentum. See, e.g., U.S. Pat. No. 4,370,718.

It is also known to control traffic and traffic signals based on local requests for service. See, e.g., U.S. Pat. No. 4,322,801.

It is also known to control traffic and traffic signals based on the detection of vehicles and pedestrians at an intersection. See, e.g., German Patent No. DE 2,739,863.

It is also known to control traffic and traffic signals on a local level in conjunction with an area-wide traffic control system. See, e.g., U.S. Pat. No. 5,257,194.

It is also known to alert motorists of traffic situations via the use of real-time traffic images. See, e.g., U.S. Pat. No. 5,396,429.

It is also known to use scanning transmissometers to warn motorists of decreased visibility. See, e.g., U.S. Pat. No. 5,771,484.

It is also known to provide motorists with accident information based on a vehicle's current driving conditions and previous accidents that occurred under similar conditions. See, e.g., U.S. Pat. No. 5,270,708.

It is also known to alert motorists via an accident avoidance system that their vehicle is approaching potentially hazardous situations. See, e.g., U.S. Pat. No. 5,652,705.

It is also known to provide motorists with traffic information via a display inside of their vehicle. See, e.g., U.S. Pat. Nos. 5,313,200; 5,257,023; 5,182,555; 5,699,056; and 5,317,311.

It is also known to use cameras to predict traffic flow rates and to use this information to control local traffic. See e.g., U.S. Pat. No. 5,444,442. U.S. Patent No. 5,444,442 does not, however, use fuzzy logic algorithms to control traffic and traffic signals.

It is also known to control traffic and traffic signals via neural networks. See, e.g., U.S. Pat. Nos. 5,459,665; 5,668,717. However, U.S. Pat. Nos. 5,459,665 and 5,668,717 do not use fuzzy logic to control traffic or traffic signals.

It is also known to transmit traffic signal information to motorists via radio transmission. See, e.g., Japan Patent No. 3-157799. Japan Patent No. 3-157799 does not, however, distribute the information to motorists via intelligent traffic signs. Furthermore, Japan Patent No. 3-157799 does not use fuzzy logic to selectively distribute or assess the warning information.

It is also known to provide citizens with traffic information via programmable display mediums. See, e.g., U.S. Pat.

No. 5,729,214. However, U.S. Pat. No. 5,729,214 does not use fuzzy logic algorithms to selectively distribute or assess the traffic information.

It is also known to control traffic signals by modeling the traffic light phase-splits after stored traffic flow models. See, e.g., German Patent No. 2411716. German Patent No. 2411716 does not, however, use fuzzy logic algorithms to determine the optimum traffic flow.

It is also known to control traffic and traffic signals via fuzzy logic algorithms. See, e.g., U.S. Pat. No. 5,357,436 and Japan Patent No 4-148299. U.S. Pat. No. 5,357,436 and Japan Patent No 4-148299 do not, however, use fuzzy logic algorithms to selectively distribute or assess warning information to motorists.

It is also known to detect traffic using a fuzzy logic processor. See, e.g., U.S. Pat. No. 5,696,502. U.S. Pat. No. 5,696,502 does not, however, use fuzzy logic to control traffic signals and to selectively distribute or assess warning messages.

Each of the patents and articles discussed above is incorporated herein by reference.

None of the above inventions make use of fuzzy logic or expert systems to determine the distribution of traffic or danger warning information. This method of distribution is described below in detail. The use of fuzzy logic algorithms to selectively distribute relevant information to motorists, in conjunction with the use of fuzzy logic to control traffic and traffic lights creates an improved, comprehensive traffic control and warning system and method. The present invention derives control parameters for traffic lights and traffic-warning signs based on past and current real time traffic flow parameters. The present invention also warns drivers of vehicles of situations to be avoided, thus permitting individual driver actions that will minimize future aggravation of congestion or dangerous traffic situations. Centralized and distributed fuzzy logic calculations are used to derive control and warning message parameters. These calculations are arranged to respond to past traffic flows and present traffic measurements and dangerous situations, and to minimize future aggravation of situations of concern.

SUMMARY OF INVENTION

The present invention is a system and method for controlling traffic and traffic lights and selectively distributing warning messages to motorists. Fuzzy logic is used to dynamically derive traffic light phase-splits (i.e. the time split between red and green for a given traffic light cycle) based on traffic flow patterns and other factors such as weather conditions, predicted increases in traffic for rush hour or special events, etc. Warning signals are also broadcast to motor vehicles and/or to fixed or portable traffic warning signs. The GPS coordinates of the vehicles and/or signs are known or are calculated from received GPS satellite signals. The warning messages may include unusual traffic light phase-splits, traffic congestion information, dangerous situation information including fuel or chemical spills, accident information, etc. Fuzzy logic controllers in signs or in vehicles calculate danger warning signals and deliver appropriate messages to drivers based on the received information and the current GPS coordinates of the vehicle or traffic warning sign. Thus fuzzy logic is used to calculate traffic light phase-splits and also to calculate appropriate danger warning messages based on the calculated phase-splits and other traffic conditions. Fuzzy logic calculations may be made at a central controller or on a distributed basis at the traffic lights, warning signs or in the vehicles. Different combinations of centralized and distributed calculations may also be used. A totally integrated fuzzy logic based expert system and method for traffic flow control results with control of traffic signals and coordinated control of messages to vehicles and signs to further improve traffic flow and relieve congestion results.

The present invention includes various traffic information units that obtain traffic information. The traffic information units have intelligent controllers. The traffic information is transmitted to one or more central controllers. The central controller or controllers is/are used to determine congestion parameters and warning information. The congestion parameters and the warning information are transmitted from the one or more central controller(s) to the intelligent controllers. The intelligent controllers are used to determine appropriate action based on the congestion parameters and the warning information.

The present invention also includes one or more traffic lights with intelligent controllers. The traffic lights with intelligent controllers include receivers that receive and analyze communication signals from a central control, a transmitter that generates and transmits signals to traffic lights with cameras and traffic lights with intelligent signs, and a computer controller including a processor and memory.

The present invention also includes one or more traffic lights with intelligent warning signs. The traffic lights with intelligent warning signs comprise a receiver that receives and analyzes communication signals from traffic lights with intelligent controllers and a warning sign that displays warning messages to motorists.

The invention further includes one or more intelligent road-side warning signs that comprise receivers that receive and analyze communication signals from traffic lights with intelligent controllers or the central controllers, and a warning sign that displays warning messages to motorists. The intelligent road-side warning signs may be at permanent, fixed locations, or they may be portable warning signs. The traffic warning signs have known geographic coordinates, such as GPS coordinates, used to determine which messages to display on which signs. Portable traffic warning signs may include GPS receivers to derive variable location information.

Furthermore, the invention includes one or more traffic lights with cameras that monitor intersections or roads, receivers that receive and analyze communication signals from traffic lights with intelligent controllers, and transmitters that generate and transmit signals to traffic lights with intelligent controllers. Captured video signals may be transmitted to a central control station for evaluation by human operators or for automatic evaluation using image analysis software.

The invention also includes one or more road-side traffic and weather sensors that include transmitters that generate and transmit signals to central controllers.

In addition, the present invention includes vehicle-warning units in motor vehicles. The vehicle warning units include receivers that receive and analyze communication signals from central controllers. The vehicle warning units also include satellite receivers that receive and analyze communications signals from a satellite positioning system and determine current geographic location of the warning unit, transmitters that generate and transmit data to the central controllers, and alarm indicators that indicate relevant traffic situations or emergencies.

Similarly, portable traffic signs and warning signs may be setup to receive information similar or identical to the information that is sent to motor vehicles. That is that a mobile traffic sign may incorporate GPS position location systems to enable it and the central controller to know the location of the movable sign. Given that the signs may be movable, the current position of the sign would be input information helpful in determining the appropriate warning notification sent to the sign for posting on the sign. The information could also be used at the sign for coordinated communications with other mobile signs, stationary signs, or with traffic light controllers as well as with the central controllers.

The invention also includes central controllers. The central controllers include database computers having a database storage unit and processors with memories configured to monitor existing traffic conditions and emergency situations and distribute warning messages. The central controllers also include receivers that receive and analyze communication signals from traffic sensors, traffic lights with intelligent controllers, and vehicle warning units. Furthermore, the central controllers include transmitters that generate and transmit signals to traffic lights with intelligent controllers, vehicle warning units and road-side warning signs.

In operation of the present invention, the traffic lights with cameras transmit images to traffic lights with intelligent controllers, and the traffic lights with intelligent controllers transmit the images to central controllers. The traffic and weather sensors transmit traffic and weather data to the central controllers. The vehicles with warning units transmit data to the central controllers. The central controller receives and processes data from the traffic lights with intelligent controllers, vehicle warning units and traffic sensors and determines the traffic congestion parameters. After determining traffic congestion parameters, the central controller transmits congestion parameters and warning information to the traffic lights with intelligent controllers, the road-side warning signs and the vehicle warning units.

Upon receipt of the transmitted data, the traffic lights with intelligent controllers determine if warning information is applicable to associated intersections and transmits any applicable warning information to the traffic lights to adjust traffic light phase-splits and to warning signs and to the roadside signs. Alternatively, the information for roadside-warning signs may be transmitted directly from the central controller. Upon receipt of the transmitted data, the roadside warning signs determine if the warning information is applicable for the associated sign and displays appropriate warnings. Upon receipt of the transmitted data, the vehicle warning units determine if warning information is applicable to each vehicle and alerts motorists of any relevant warnings.

The present invention uses a Global Positioning System (GPS) system to determine locations of portable signs and vehicles. GPS coordinates are also used to identify intersections, fixed location signs, and coordinates of trouble such as accidents. The satellite receivers of the invention are compatible with the Global Positioning System. The current geographic position of the satellite receivers are defined by the receiver's GPS coordinates. While the invention is described in terms of GPS technology, it is to be understood that other methods of determining coordinate location information may be used.

In addition, the present invention also includes emergency vehicles with GPS location receivers and processors to precisely locate the vehicle and to report location, movement and destination to the central controller for use in generating traffic management controls.

The present invention includes fuzzy logic controllers. The fuzzy logic controllers execute fuzzy logic inference rules from a fuzzy rule base. The execution of these rules using the defined rule base analyzes traffic congestion and decides on appropriate actions. Appropriate actions may be traffic control action, or it may be appropriate traffic information distribution. The fuzzy logic controllers also use fuzzy logic to derive the warning information based on avoidance level of dangerous situation and distance to dangerous situation and detection of abnormal phase-splits of traffic lights.

Fuzzy logic may be incorporated into the computations at several levels of the traffic control system. A first fuzzy logic calculation would be at the data gathering and phase split determination stage of the traffic control process. Here the fuzzy logic inputs would be, for instance, the volume of traffic that is entering the zone of the intersection and the relative direction and speed of the traffic from several directions. Given these inputs, and there may be many input variables, the calculation will proceed in the generation of the traffic light phase splits. A second fuzzy logic calculation would involve the affect of the phase splits and other input factors such as vehicle speed and direction that would be input into the fuzzy logic calculation. The output of this calculation would be, or could be, advice to a moving vehicle to take certain actions to avoid or minimize vehicle travel to congested or otherwise dangerous locations. Such actions could also be designed considering the phase splits of traffic lights calculated in the first fuzzy logic calculation. These and other aspects of the process are further discussed below.

Fuzzy logic calculations may be made at the central controllers or distributed in the intelligent traffic light controllers, warning sign controllers, or in the motor vehicles controllers. The central controller receives congestion parameters from traffic lights with cameras, from road-side traffic sensors, from weather sensors, and/or from other sources. The central controller may make fuzzy logic calculations based on the received information for transmission. The central controller then may transmit specific traffic light phase-splits to the various traffic lights under its control. The central controller may also transmit specific warning message information to the intelligent road-side traffic warning signs.

Alternatively, the central controller may analyze received traffic congestion information and transmit control parameters to distributed fuzzy logic controllers located at intelligent traffic light controllers and/or in intelligent road-side sign controllers. The respective distributed fuzzy logic controllers then may perform fuzzy logic calculations to derive local control information and/or warning sign information. Distributing fuzzy logic calculations to the actual intelligent traffic light controllers or road-side signs reduces the load on central controllers. In any event, the results of the fuzzy logic calculations are sent back to the central controller to update the controller data base with current statue information reflecting the state of the traffic light phase-splits and the warning sign messages.

The present invention uses fuzzy logic to determine the optimum traffic light phase-split based on the traffic volume parameters at the intersection. The traffic light phase-split fuzzy logic calculation may be made at the intelligent traffic light controller or at the central controller.

Separate additional fuzzy logic calculations are made to warn drivers of individual vehicles of dangerous situations or traffic situations to be avoided. These calculations are best made in controllers located in individual motor vehicles. The operation is as follows. The central controller analyzes received traffic conditions, transmits appropriate traffic light and roadside sign control messages, and maintains a current traffic control database. The central controller broadcasts messages to motor vehicles indicating the locations (GPS coordinates) of traffic congestion, dangerous situations, or areas to be avoided. Also, for each such situation, a numerical avoidance level parameter is transmitted. All vehicles in a given geographic area receive the same broadcast messages from the central controller. Each vehicle also has a GPS receiver to determine its own location and direction of travel. Compasses or accelerometers can also be used to determine direction. The vehicle speed can also be computed from successive GPS readings and/or from vehicle speedometer readings. Based on the received GPS coordinates of each situation to be avoided, the calculated GPS coordinates of the vehicle and the vehicle direction of travel, each vehicle fuzzy logic controller computes a danger warning index for that situation, indicating to the driver the degree of danger presented by each situation. The driver is made aware of situations to be avoided and the fuzzy logic calculated degree of danger or concern by audio announcement or visual message display.

In one embodiment, then, the intelligent traffic control and warning system and methods of the present invention make use of both centralized and distributed fuzzy logic controllers and calculations to control traffic flow. Furthermore, the outputs from one calculation are used as inputs to the second calculation. Traffic light phase-split messages are derived using a first fuzzy logic calculation. These calculations are based on real time traffic flow parameters and information. In attempt to avoid or minimize future aggravation of bad situations, second distributed fuzzy logic calculations are made at individual vehicles and for traffic warning signs. These calculations are based, in part on the results of the first traffic light and warning sign control fuzzy logic calculations, and also on each signs location and each vehicles current location, direction of travel, speed, etc.

It is therefore an object of this invention to provide new and improved traffic control systems and methods to improve the safety and reduce congestion on roadways.

It is a further object of this invention to provide an intelligent traffic light control system and method that incorporates fuzzy logic and expert systems technology to control the phase-splits of the traffic lights at intersections.

It is a further object of this invention to obtain traffic information from various sources and determine congestion parameters and warning information based on the obtained traffic information and to further determine appropriate action to be taken based on the congestion parameters and the warning information.

It is a further object of the invention to use fuzzy logic, intelligent systems, or expert systems to control and optimize the operations and processes of the present invention.

It is also an object of the invention to use fuzzy logic to determine congestion parameters and warning information.

It is also an object of the invention to use fuzzy logic to determine appropriate action such as appropriate traffic control action or appropriate traffic information distribution.

It is also an object of the invention to use fuzzy logic to derive warning information.

It is a further object to integrate intelligent traffic control signs for the display of traffic warning and direction signals to inform drivers of dangerous or congested traffic situations to be avoided and for such signs to operate in coordination with fuzzy logic derived traffic light control signals.

It is still a further object of this invention to use GPS satellite location signals to accurately locate vehicles and to use vehicle location, direction of travel, and velocity information to allow vehicle controllers to selectively respond to radio transmitted warning messages and advice for avoiding dangerous or congested areas.

It is yet another object to provide a traffic control and warning system and method that operates with multiple control centers wherein individual vehicles communicate with a selected center depending on the vehicles GPS coordinates and the location of the vehicles and the various control centers.

It is another object to use GPS technology to accurately track the location of emergency vehicles, to use this information to better control the traffic surrounding an emergency vehicle, and to use this information to provide warnings to motorists of approaching emergency vehicles.

It is another object to permit vehicles to communicate with multiple control centers with cellular telephone like handoff procedures as the vehicle travels from the area of one control center to that of another control center.

It is still another object to integrate fuzzy logic control of individual traffic lights with GPS warning and control messages transmitted from central controllers to individual vehicles with displayed vehicle warnings based on the calculated locations of those vehicles.

It is another object to select particular fuzzy logic inference rules for traffic light control based on particular conditions that may affect traffic flow such as weather or predicted unusual traffic conditions such as those that might be encountered with special events such as major sport attractions.

Yet another object is to select particular fuzzy logic inference rules for the distribution of traffic/danger warnings.

Further objects of the invention are apparent from reviewing the summary of the invention, detailed description, and claims set forth below.

BRIEF DESCRIPTION OF THE DRAWINGS

The present inventions are better understood in conjunction with the following drawings and detailed descriptions of the preferred embodiments. The various hardware and software elements used to carry out the invention are illustrated in the attached drawings in the form of block diagrams, flow charts, and other illustrations.

FIG. 11 is a diagram illustrating possible warning messages that may be displayed/transmitted at various intersections.

DETAILED DESCRIPTION OF THE DRAWINGS

Figure 1:
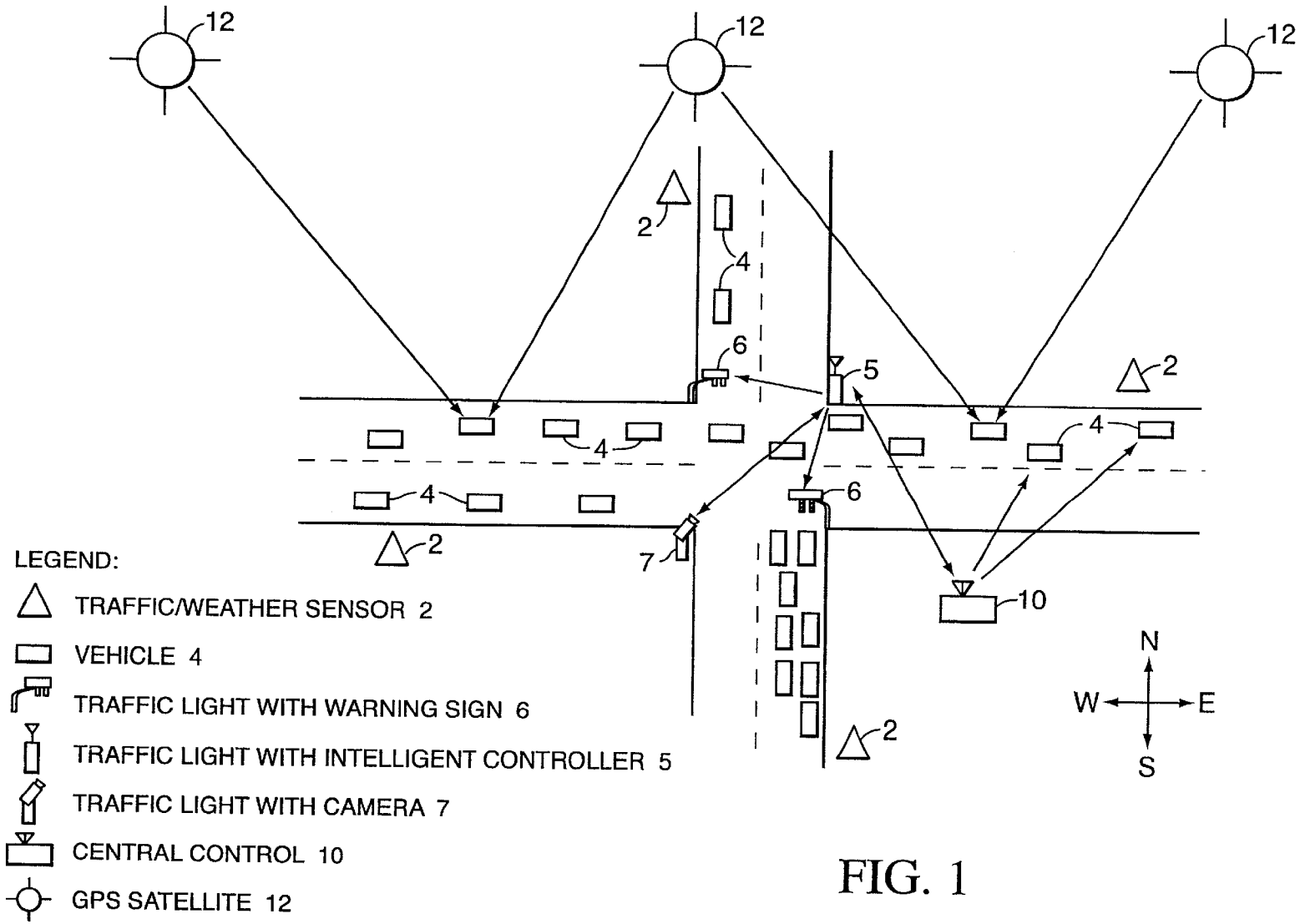
FIG. 1 is a diagram illustrating the location of the elements of the traffic control and warning system and method at an intersection.

FIG. 1 illustrates the traffic control system at an intersection. The traffic/weather sensors 2 are located next to the street and collect the traffic volume and/or weather condition data. Vehicles 4 are at various locations on the street. The vehicles 4 may be standard passenger vehicles, trucks, busses, etc., or they may be emergency vehicles such as police or fire vehicles. Both standard vehicles and emergency vehicles may be controlled from the same integrated system and method taught in the present invention.

Traffic lights with warning signs 6 are located at the comers of the intersection. A traffic light that includes a camera 7 for monitoring the intersection is located next to the intersection. A traffic light with an intelligent controller 5 to control the phase-split of the lights and the warning messages displayed is also located next to the intersection. As further described below, fuzzy logic is used to derive optimal traffic light phase-splits between green and red lights depending on traffic flow. Central control 10 receives data from the traffic sensors 2 and other auxiliary inputs, and central control 10 analyzes the information to determine messages to be transmitted to the traffic light with intelligent controller 5 and to automobiles 4. The traffic/weather sensors 2 located on the street communicate messages to the traffic light with intelligent control 5 or the central controller 10 about approaching vehicles 4 and weather conditions. Weather information may also be received from local weather data services. Other street condition information may be received from other local authorities such as police, highway patrol, etc. Signals from GPS satellites 12 are used to calculate the position and direction of travel of vehicles that carry traffic warning controllers 50 and the positioning of portable signs 20.

Figure 2:
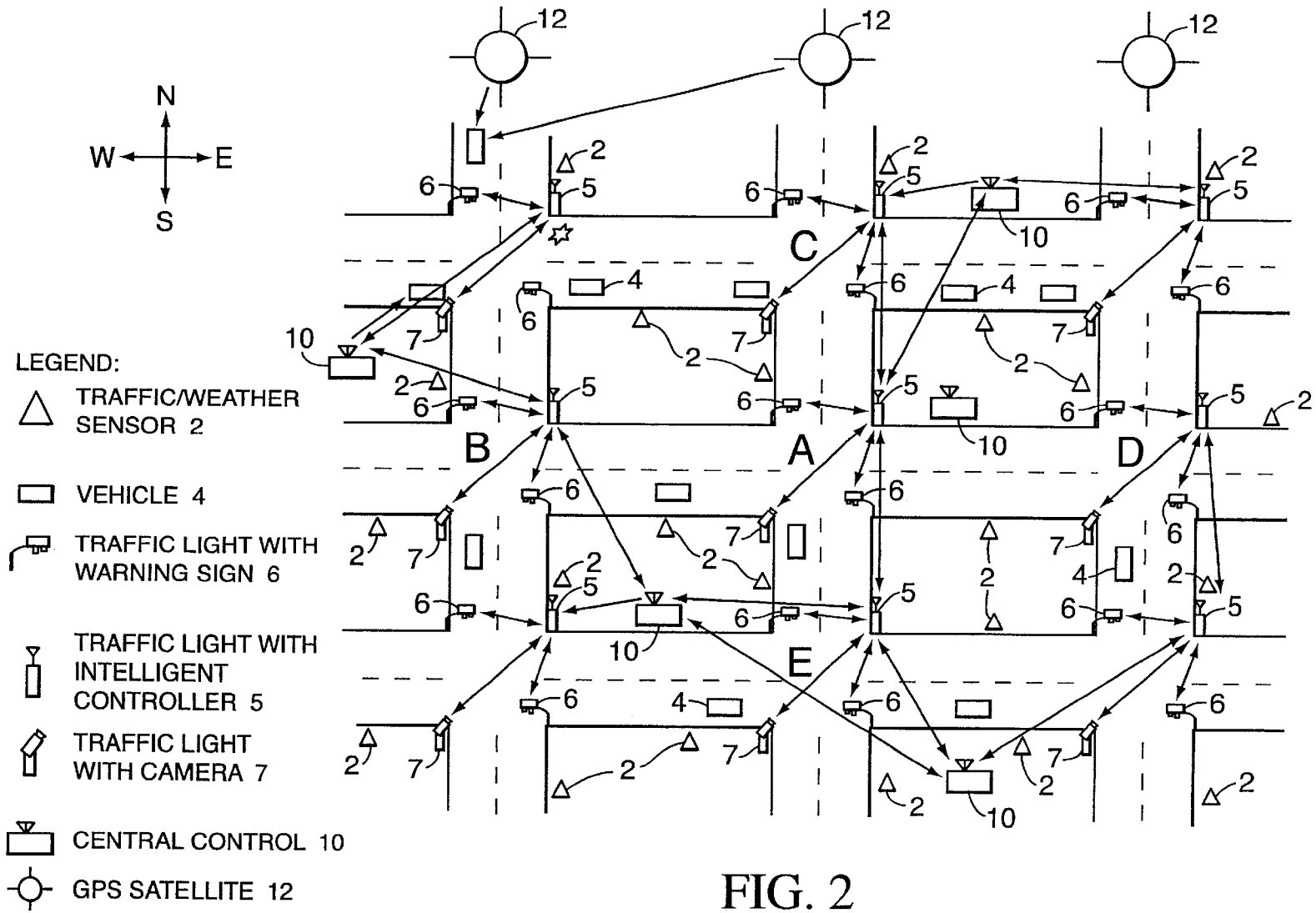
FIG. 2 is a diagram illustrating the traffic control and warning system and method used simultaneously at a number of intersections.

FIG. 2 illustrates several intersections operating under control of the intelligent traffic control and warning system and method of the present invention. The operations of the components are similar to those of FIG. 1. Traffic lights with intelligent controllers 5 are in communication with traffic lights with a camera 7 and traffic lights with warning signs 6. Traffic lights with intelligent controllers 5 are also in communication with central control centers 10, and central control units 10 are in communication with each other. While multiple central controllers 10 are illustrated in FIG. 2, it is to be understood that a fewer number of such controllers 10 may be used to serve larger geographic areas. The number of controllers 10 will depend on the computational capabilities of individual controllers and the communication facilities available to communicate between the various traffic sensors and the controllers 10. Indeed, in some cases it may be possible for a single controller to manage a large neighborhood, or even perhaps a town or city.

Figure 3:
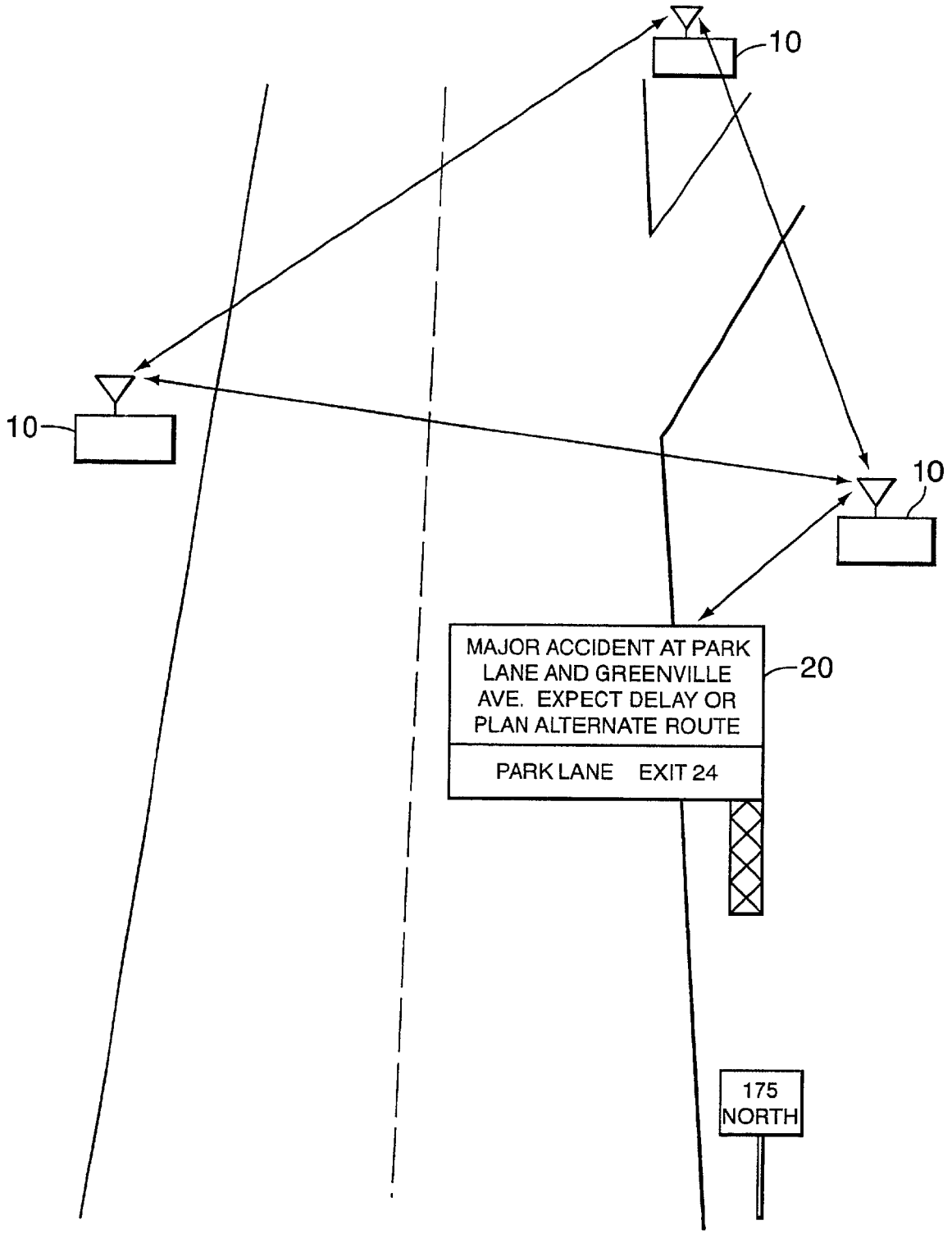
FIG. 3 is a diagram illustrating a traffic warning sign on a highway.

FIG. 3 is an illustration of a traffic warning sign 20 that is located on a freeway. The warning sign 20 may also be in a portable configuration. FIG. 3 shows that the traffic warning sign 20 is in communication with a control center 10 and that the control centers 10 are in communication with each other. The traffic warning sign 20 may communicate directly with the control center 10 or with the control center 10 via local controller 5 of FIGS. 1 and 2. Communication may be via dedicated communications facility or via shared networks, including radio links such as used in standard cellular telephone networks. The above communication links provide a network for the control centers 10 to control both the traffic lights and warning signs which provide an integrated intelligent traffic control and warning system and method.

Figure 4:
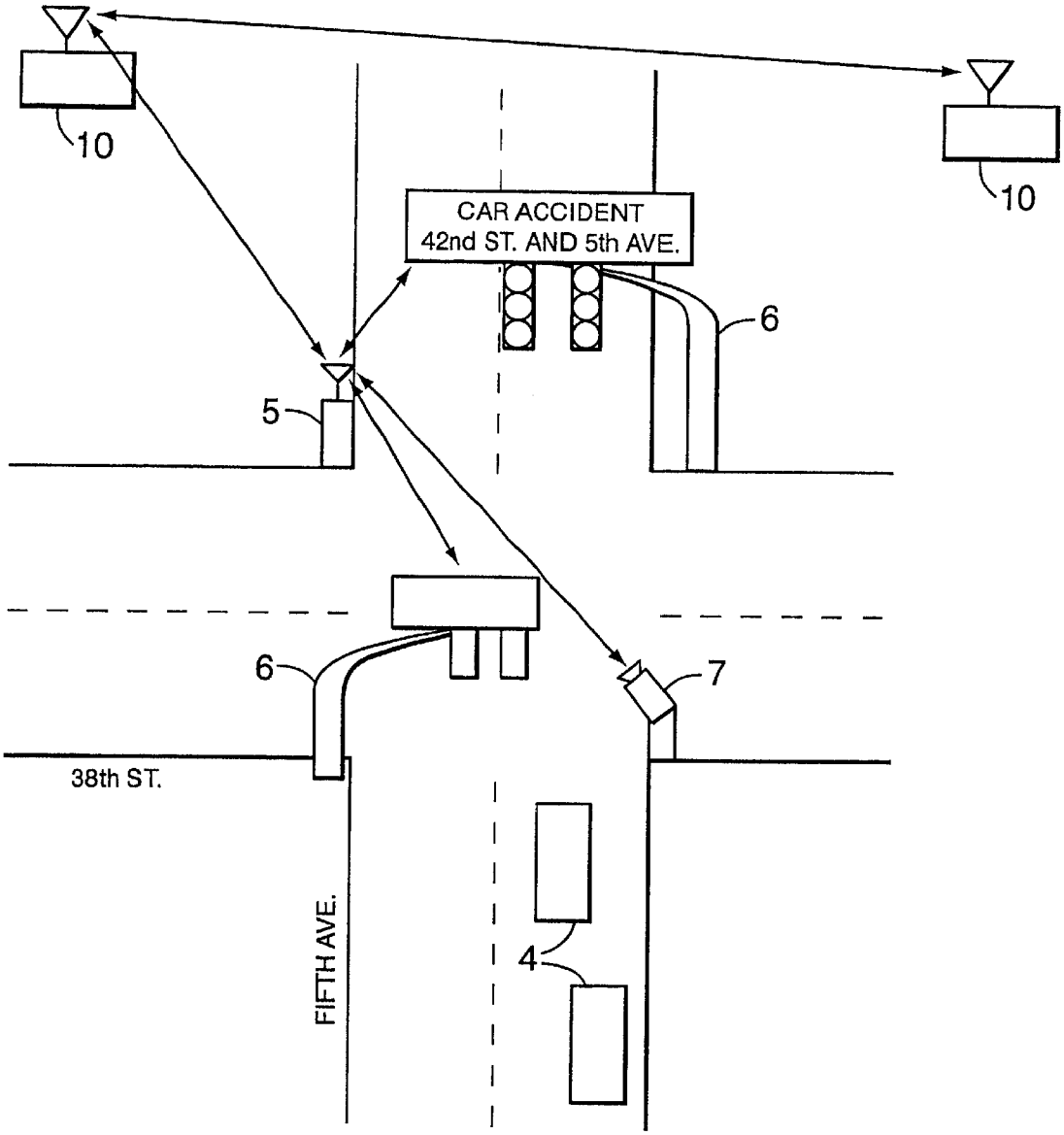
FIG. 4 is a diagram illustrating a traffic warning sign above a traffic light.

FIG. 4 is an illustration of an intersection with a traffic light with warning sign 6 that is displaying a traffic warning message. The traffic light with intelligent controller 5 communicates with and controls the traffic light with camera 7 and the traffic lights with warning sign 6. The control center 10 communicates with and controls the traffic light with intelligent controller 5. FIG. 4 shows the traffic light with warning sign 6 informing motorists of a car accident that is four blocks ahead. Upon receipt of this information, the driver will be able to change his/her route to avoid the traffic jam that is just ahead. In addition to warning the driver of the car accident via the warning sign 6, the present invention informs the driver of the traffic accident via radio communications using GPS coordinates as described below.

Figure 5:
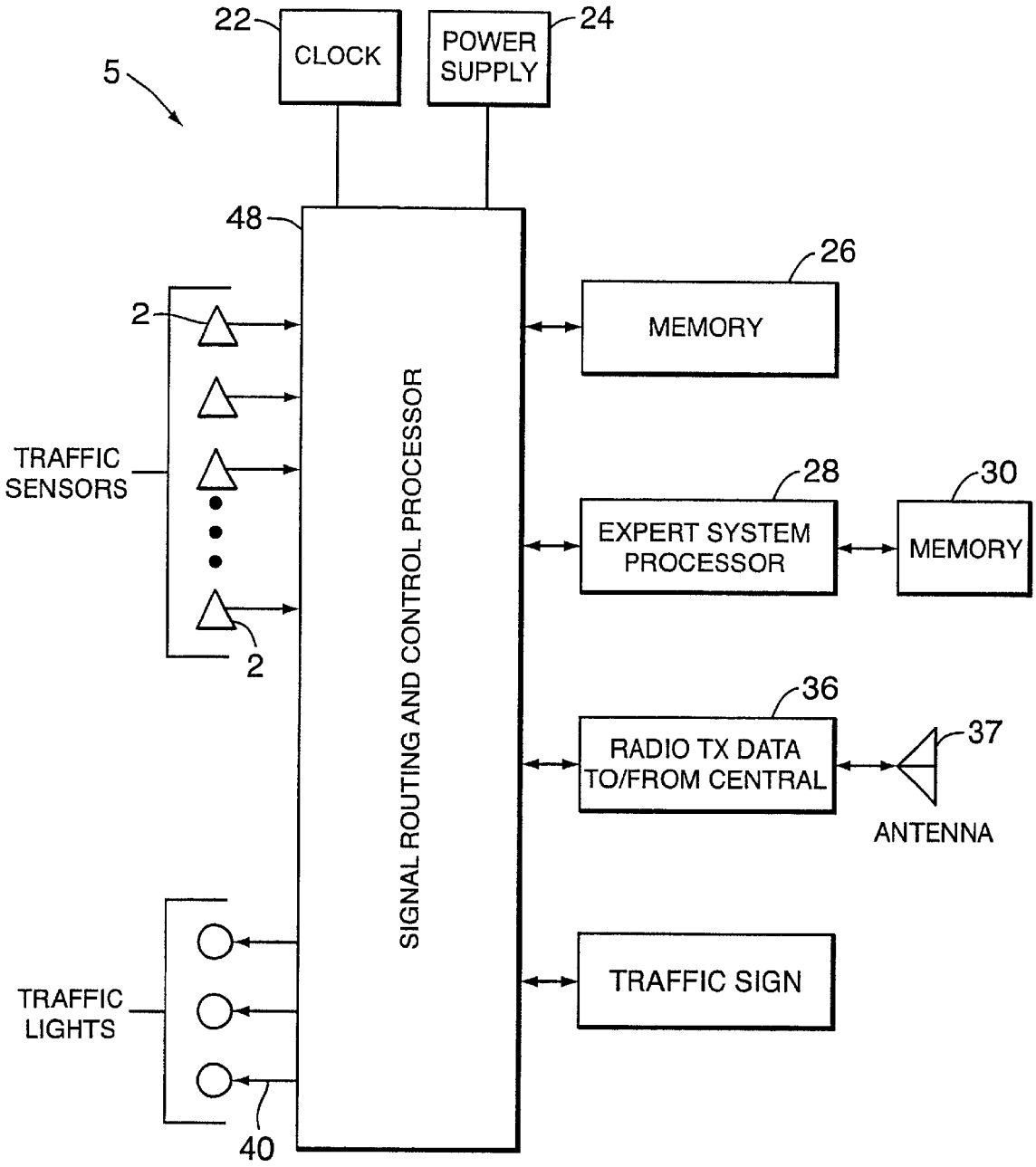
FIG. 5 is a block diagram of an intersection controller for traffic lights, warning signs, and warning radios.

FIG. 5 is a block diagram that depicts the intelligent intersection controller 5. The controller 5 comprises a combination of modern communication technology and advanced low cost compact electronics. Signal routing and control circuitry 48 is used to couple and/or interconnect the various system elements and may be implemented with well known microprocessor and signal multiplexing control circuitry. The controller 5 keeps track of time via the clock 22. The controller 5 is powered by the power supply 24. Memory 26 is used to store necessary information for the operation of the intelligent traffic control and warning system. The expert system processor 28 and memory 30 use fuzzy logic decision rules to determine the phase-splits for the traffic lights and also determine which traffic warning signs are to receive specific warnings. The radio 36 and antenna 37 are used to communicate with control centers 10. The figure illustrates that in addition to transmitting messages via radio transmission, the intelligent controller 5 also transmits phase-split information and warning messages via wire links 40. Traffic sensors 2 provide data about the volume of traffic on particular streets.

Figure 6:
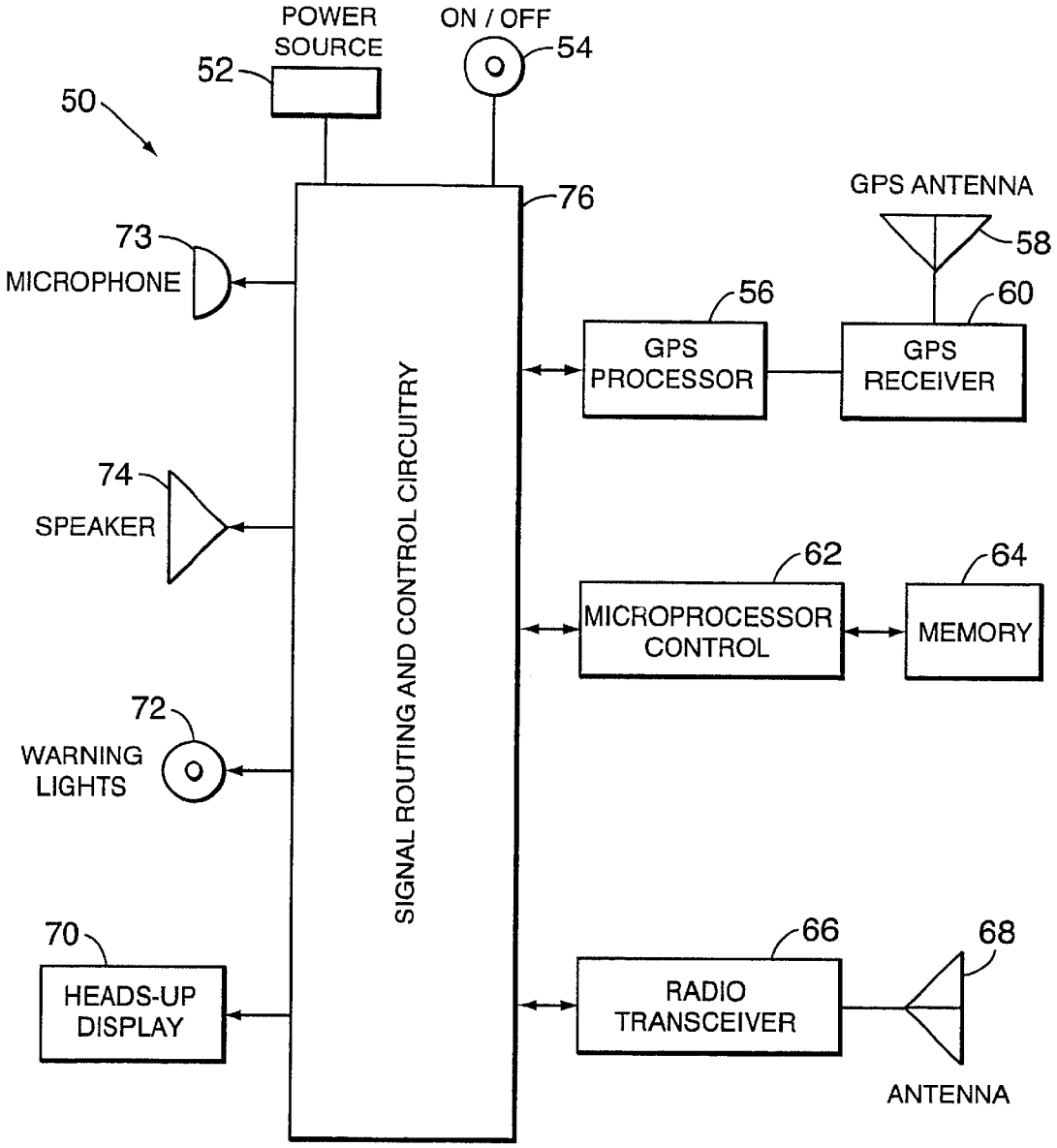
FIG. 6 is a block diagram of a vehicle warning unit.

FIG. 6 depicts a vehicle traffic warning controller and communication unit 50. The unit 50 comprises a combination of modern communication technology and precise geographic location capability derived from GPS satellites, which are implemented with advanced low cost compact electronics. Signal routing and control circuitry 76 is used to couple and/or interconnect the various system elements and may be implemented with well known microprocessor and signal multiplexing control circuitry. The vehicle traffic warning controller and communication unit 50 is powered by the power source 52. The power source 52 may be in the form of self-contained batteries, or the automobile battery. The vehicle traffic warning controller and communication unit 50 is turned on and off by the on/off switch 54, or it may be automatically activated by remote control or by starting the vehicle. The vehicle traffic warning controller and communication unit 50 is able to calculate its location and direction of travel via use of GPS processor 56, GPS receiver 60, and the GPS antenna 58. Using the received GPS signals, the vehicle control unit can calculate its position in real time and then use that information in determining appropriate responses to received warning messages. The vehicle GPS coordinates can also be used to assist in controlling communications with multiple central control centers, permitting selection of the closest control center with automatic hand-off procedures implemented when travelling from one control center zone to another. The microprocessor control 62 along with the memory 64 is used to control the overall operation of the vehicle traffic warning controller and communication unit 50. The transmitter/receiver (TX/RX) radio 66 and antenna 68 are used to communicate with the control centers 10. Such communication may be via dedicated radio links or via shared public radio telephone networks such as conventional cellular telephone networks. Two-way voice communications permits advising the central control station of emergencies that may involve the transmitting vehicle or reports of driver observations of other emergency or traffic congestion situations. The heads-up display 70, warning lights 72, and speaker 74 are all used to communicate messages to the user of the unit 50. The microphone 73 enables vehicle occupants to communicate with the control centers 10 in FIGS. 1 and 2.

Figure 7:
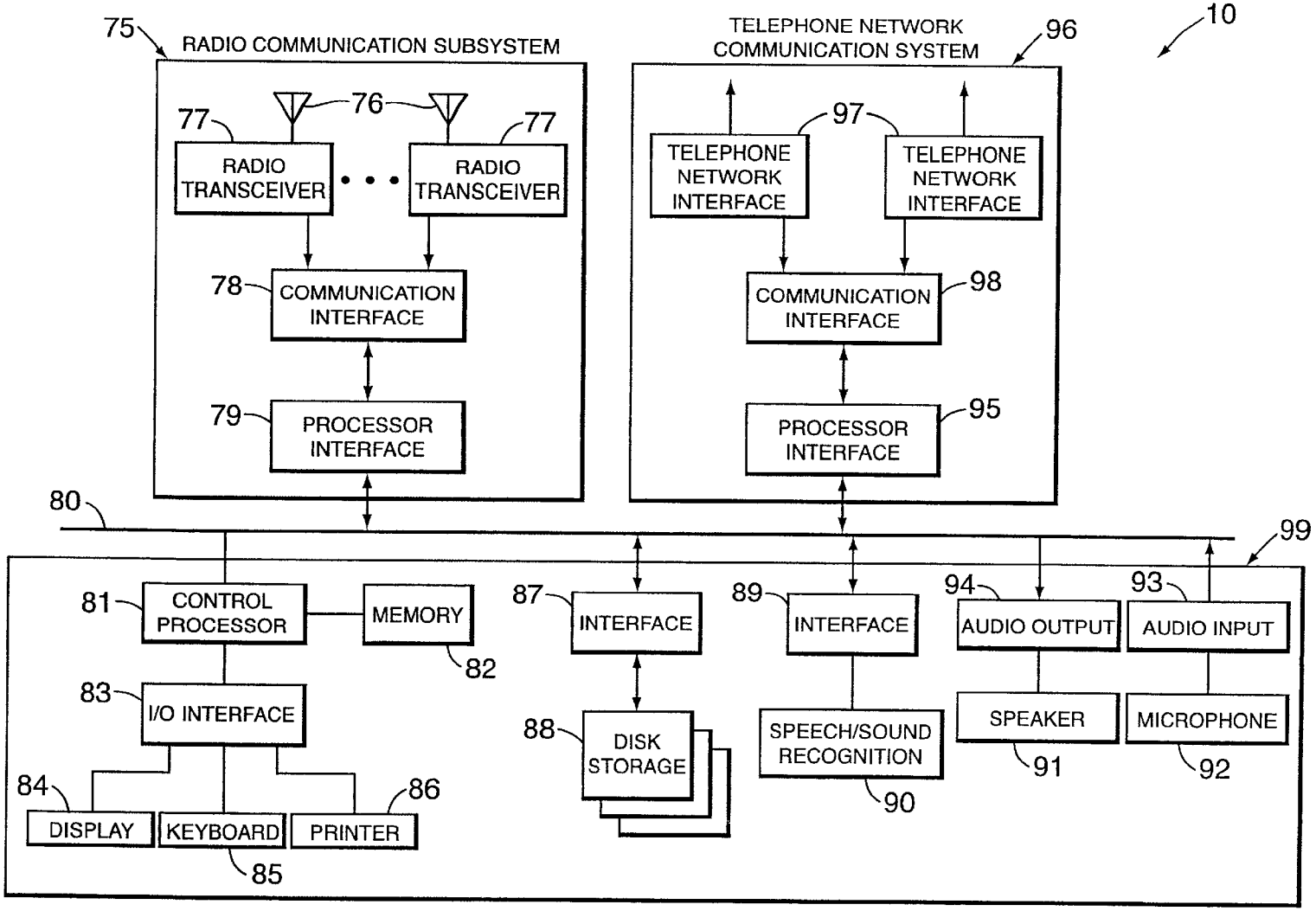
FIG. 7 is a block diagram of the central control center for traffic control and warning system and method.

FIG. 7 depicts in block diagram form the structure of the central control center 10. The control center 10 comprises the computer control system 99 coupled with various communication units. The computer system 99 includes the control processor 81 with its associated memory unit 82. The control processor 81 is used to coordinate overall activities within the intelligent traffic control and warning system and method. Operator control is provided via input/output (I/O) interface 83 along with display terminal 84, keyboard 85, and printer 86. Disc storage 88 and interface 87 provide storage for information that is required by the control center (i.e. GPS street maps, fuzzy logic algorithms, etc.) for operation of the intelligent traffic control and warning system and method. In the preferred embodiment, the speech/sound recognition 90 and interface 89 are provided so that the control center 10 is capable of detecting verbal warnings or alarming sounds (i.e. car accidents) that may be transmitted by vehicle traffic warning unit 50 (FIG. 6). Audio output is provided through the audio unit 94 and speaker 91. In addition, audio input is provided by a microphone 92 and audio input circuitry 93. The speaker 91 and the microphone 92 enable control center personnel to communicate directly with users of vehicle traffic warning units 50 as well as with emergency response personnel located throughout the network area being served.

The control center 10 of FIG. 7 also includes a radio communication subsystem 75 for communicating with traffic lights with associated intelligent intersection controllers 5 (FIG. 5), road-side warning signs 20, and vehicle traffic warning units 50. The radio communication subsystem 75 comprises antennas 76, radio transceivers 77, communication interface 78, and processor interface 79. In addition, the control center 10 may support communications with a telephone network communication subsystem 96. The telephone network based communications subsystem comprises communication interfaces 98 and processor interface 95 to allow the control center 10 to communicate with the individual intersections via various telephone network interfaces such as telephone network interfaces 97. Such telephone network interfaces may include, for example, conventional modems, direct digital interfaces, fiber optic interfaces, etc. The radio and telephone communication subsystems 75 and 96 are coupled and interconnected with the computer system 99 via the interconnect circuitry 80. The interconnect circuitry 80 may be implemented using digital bus technologies, various forms of local area networks, or other communications facilities well known to those skilled in the art.

The present system disclosed herein for controlling traffic and traffic lights is based on the generation of indices indicative of the level of traffic congestion and/or other dangerous or troublesome situations to be avoided. The factors involved in making such computations are many and complex requiring a structured and logical approach in organizing large amounts of data and information. From that information, the present invention generates indices indicative of required control actions and actual avoidance levels in different areas based upon multiple inputs from surveillance scanning systems and from database computers. Problems of this type generally benefit from the use of expert system technology with preprogrammed decision rules based upon expert experience reflecting proper response to various situations. Various such expert system approaches are possible and may be used in the danger warning and emergency response dispatch systems and methods disclosed herein. Indeed, it is the intent that the present invention described herein not be limited to any particular data analysis and organization methods. However, a particularly attractive method that demonstrates the interrelationship of the various variables and the logical operations necessary to generate the desired indices and corresponding control and dispatch messages is that of fuzzy logic. The complexities and range of options in the traffic control and traffic light system described herein makes fuzzy logic an ideal methodology to optimize the warning process by monitoring and analyzing the various sensor outputs according to properly weighted parameters.

The fuzzy logic controllers execute fuzzy logic inference rules from a fuzzy rule base. Input and output variables are defined as members of fuzzy sets with degrees of membership in the respective fuzzy sets determined by specified membership functions. The rule base defines the fuzzy inference system and is based on expert knowledge for system control based on observed values of the control variables. The input data defines the membership functions used in the fuzzy rules. The reasoning mechanism executes the fuzzy inference rules, converting the input data to output control values using the data base membership functions.

Figure 8A:
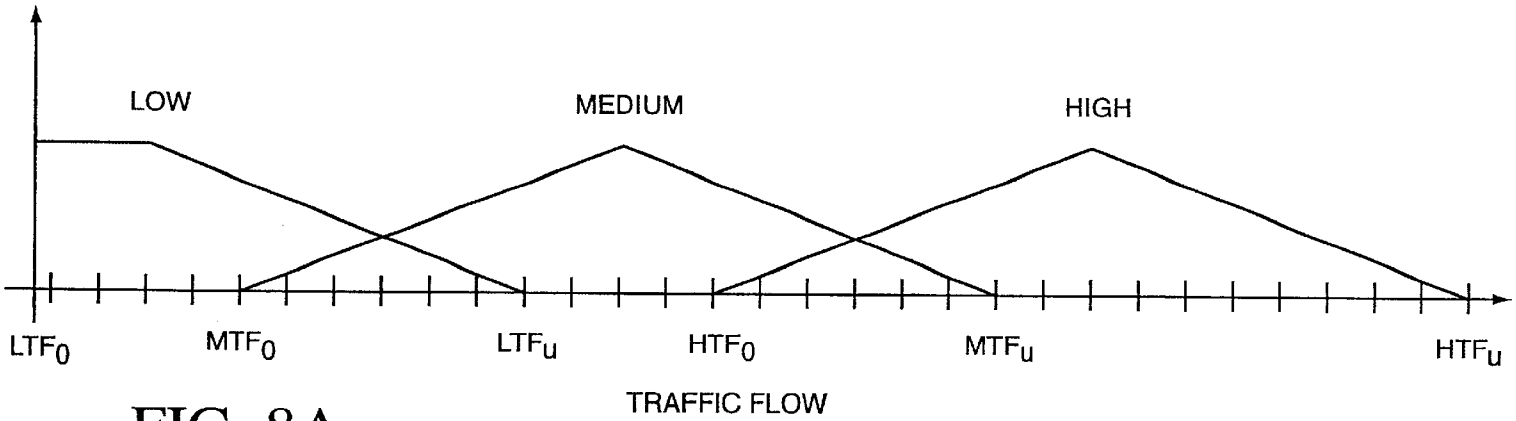
FIGS. 8A and 8B are diagrams of two graphs illustrating the traffic light control fuzzy logic relationships used by the traffic control and warning system and method.
Figure 8B:
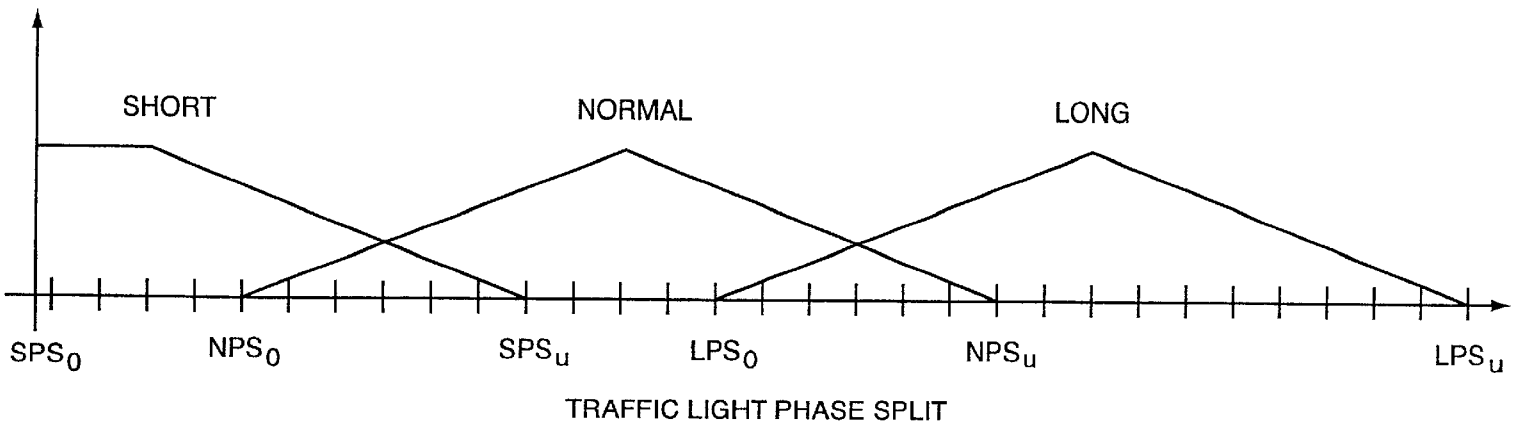

FIGS. 8A and 8B are diagrams of two graphs illustrating the fuzzy logic memberships used to control traffic and traffic lights. FIG. 8A depicts the fuzzy memberships for Traffic Flow. FIG. 8B depicts the fuzzy memberships for the Traffic Light Phase-splits that are used to better control the flow of traffic. To better understand the fuzzy logic compositional rules applied to the fuzzy traffic and emergency system and method disclosed herein, the Traffic Flow variable shown in FIG. 8A is considered. The fuzzy set corresponding to "Low Traffic Flow" (LTF) is the set of all traffic flow between zero and the upper defined Low Traffic Flow value $LTF_u$. Similarly, the fuzzy set corresponding to Medium Traffic Flow (MTF) is the set of all traffic flows between the lowest defined Medium Traffic Flow value $MTF_0$ and the upper Medium Traffic Flow value $MTF_u$. Because of the "fuzzy" definitions of "Low" and "Medium", it will be true that the $MTF_0$ value will be less than the $LTF_u$ value ($MTF_0<LTF_u$), and the fuzzy sets will overlap. Similarly, overlap occurs between the other defined ranges of traffic flow values as clearly illustrated in FIG. 8A.

Consider the Traffic Light Phase-split shown in FIG. 8B. The fuzzy set corresponding to "Short Traffic Light Phase-split" (SPS) is the set of all traffic light phase-splits between the lower value $SPS_0$ and the upper value SPSU. Similarly, the fuzzy set corresponding to Normal Traffic Light Phase-split (NPS) is the set of all traffic light phase-splits between the lowest defined Normal Traffic Light Phase-split value $NPS_0$ and the upper defined Normal Traffic Light Phase-split value $NPS_u$. Because of the "fuzzy" definitions of "Short" and "Normal", it will be true that the $NPS_0$ value will be less than the SPSU value ($NPS_0<SPS_u$), and the fuzzy sets will overlap. Similarly, overlap occurs between the other defined ranges of traffic light phase-split values as clearly illustrated in FIG. 8B. In the example shown, the phase-split determines the relative green to red time ratio for the North-South street. The time ratio for the East-West street is the complement of the time ratio for the North-South street. In other words, if the green light for the North-South street is long, then the green light for the East-West street will be short. The nature of the overlapping membership functions for several of the variables involved in the disclosed traffic warning system and method is illustrated in FIGS. 8A and 8B. Similar relationships would exist for other variables not shown.

Figure 9:
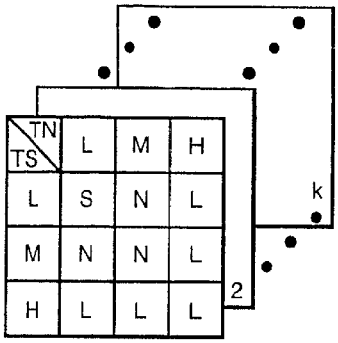
FIG. 9 illustrates the fuzzy logic decision rules used by the traffic light control and warning system and method.
Figure 9:
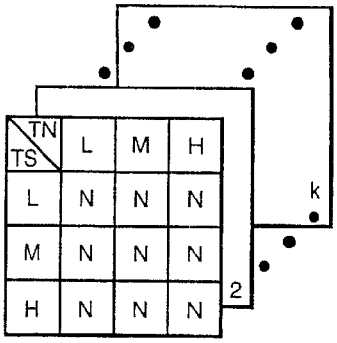
Figure 9:
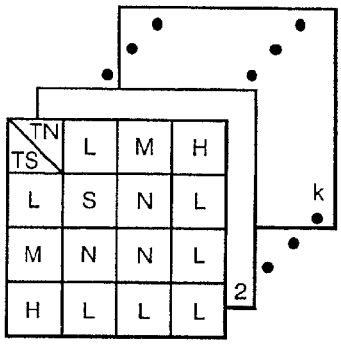
Figure 9:
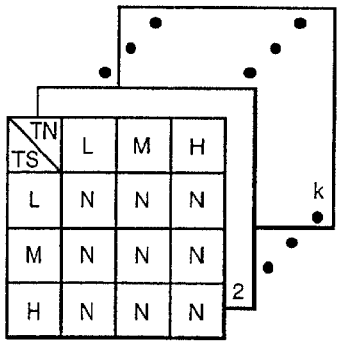
Figure 9:
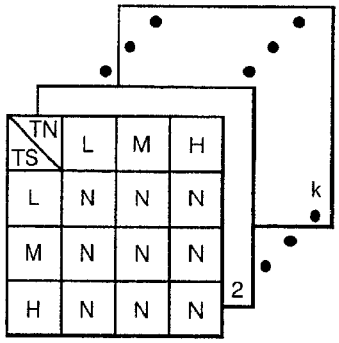
Figure 9:
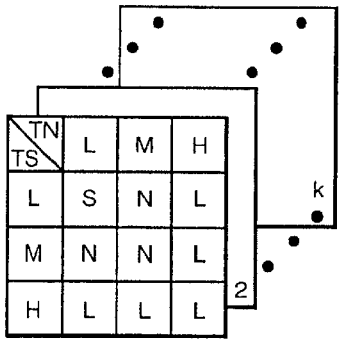
Figure 9:
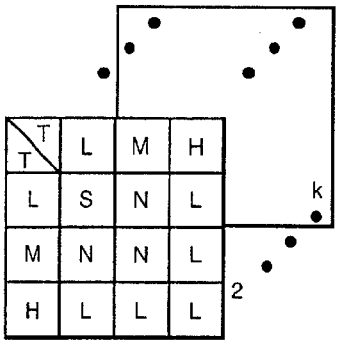
Figure 9:
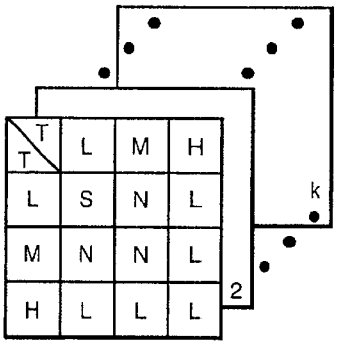
Figure 9:
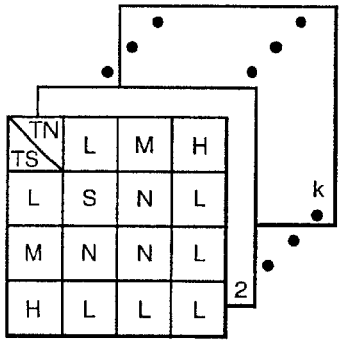

FIG. 9 depicts fuzzy logic decision rules for determining the traffic light phase-splits for a typical intersection. Each of the tables provides rules for determining the phase-split output ratio for the north/south direction of traffic for the specified east and west traffic flow membership functions. As indicated in FIG. 9, the inference rules shown are one of a set of "k" rule sets that will exist for different driving conditions. That is to say, outside factors may influence the decisions of the fuzzy logic expert system. Such outside factors may include inclement weather, an accident at a nearby intersection, or special event traffic patterns (i.e. sporting events, concerts, etc.). For each such outside factor or combination of outside factors, there may exist other unique sets of fuzzy logic decision rules of the type illustrated in FIG. 9. For example, if streets are icy, it may not be desirable to shorten green light time in either direction below a predetermined value, regardless of traffic conditions. If the green light time is too short, accident frequency may actually be increased when drivers attempt to "beat the light" on icy roads.

As an example, if the traffic flow in the easterly direction is low and the traffic flow in a westerly direction is high then the appropriate table to determine the North-South split is the highlighted upper right hand table of FIG. 9. Assume also traffic flow in north and south directions are both high. Then as indicated in the highlighted table of FIG. 9, the North-South phase-split time is favored as indicated by the Long (L) value in the table. Understand that any of these variables may be in overlapping regions, causing multiple rules to fire. The proper fuzzy logic inference rules will fire, determining in each case the appropriate phase-split depending on the degree of membership for each of the respective membership functions. Crisp values for the specific ratios will be determined by the fuzzy logic algorithm. The value for the East-West light time is simply the complement of the North-South value (i.e. East-West Time=Total Traffic Light Cycle Time minus North-South Time).

More particularly, the traffic flow membership functions of FIG. 8A illustrate three possible membership classifications: low, medium and high. These respective memberships overlap as indicated in FIGS. 8A and 8B in accordance with the principles of fuzzy logic. In other words, a particular level of traffic flow may not be considered just low or just medium but may instead overlap with the indicated varying degree of membership in the low and medium memberships. In this case, more than one fuzzy logic rule from the appropriate tables of FIG. 9 will be executed or fired. Indeed, with four fuzzy variables for east, west, north and south traffic and with each variable having membership in two overlapping regions as shown in FIG. 9, a total of sixteen ($16=2^4$) separate rules of FIG. 9 may be executed or fired for a single set of traffic measurements. Using the degrees of membership in each of the respective categories for each of the variables, the actual phase-split for the traffic lights may be determined using well known appropriate defuzzification rules such as the centroid method. The result will be specific phase-split specification defining the relative times for red and green lights within a given light cycle period.

The results of the fuzzy logic calculations are used by central controller 10 for controlling the region surrounding a given intersection. Phase-splits that are abnormal indicate a problem at a particular intersection, and the problem may then be communicated to the various traffic warning signs, such as warning signs 6 (FIG. 1) and 20 (FIG. 3). In addition, warning signals to the vehicle traffic warning units 50 in various vehicles may be transmitted along with GPS coordinates of the intersection experiencing unusual traffic. Individual vehicle traffic warning units 50 such as those shown in FIG. 6 may then compare vehicle location and movement parameters with the received coordinates of the traffic intersection generating the fuzzy logic phase-split warning. If an individual vehicle is in the vicinity of the intersection, heading toward the intersection, or otherwise involved in contributing to further congestion at the intersection, appropriate warning signals or messages may be generated for the driver via the vehicle traffic warning unit 50.

Figure 10:
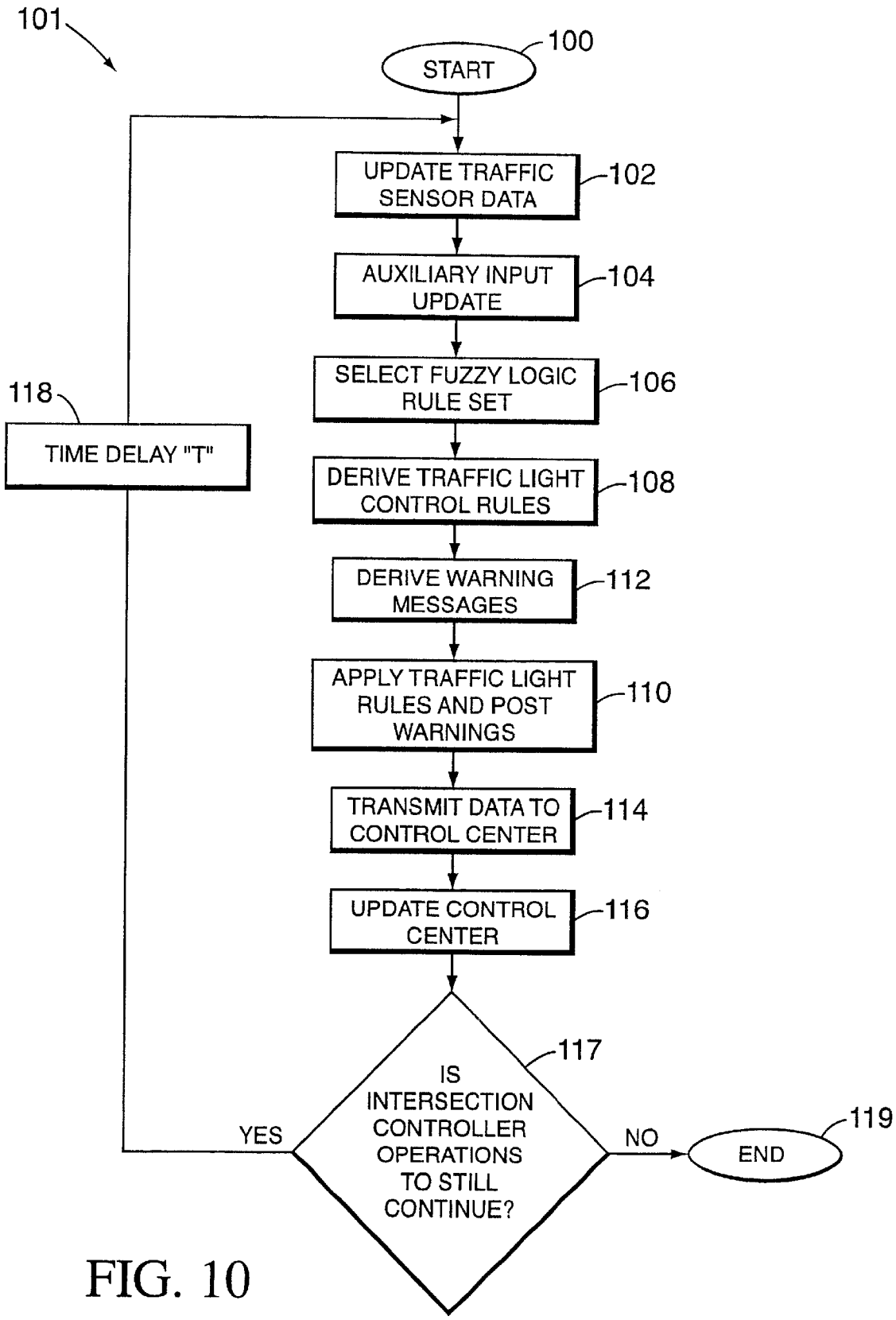
FIG. 10 is a diagram of a logic flow chart illustrating the operation of the traffic control and warning system and intersection controller.

FIG. 10 is an exemplary logic flow chart 101 for the operation of the intersection controller 5 (FIG. 5) in cooperation with the central controller 10 (FIG. 7). The flow chart 101 begins at start block 100. The intersection controller 5 updates the data from traffic sensors 2 at block 102. The controller 5 updates any auxiliary inputs (i.e. weather information, intersection monitor, etc.) at block 104. After updating all information, the control center 10 selects a fuzzy logic rule set at block 106. Based upon the rule set selected at block 106, the control center 10 derives the correct traffic light phase-split at block 108 and any warning messages that should be posted at the intersection at block 112. The control center 10 then implements the traffic light phase-splits and posts the warning messages at block 110. After implementing the new phase-splits and posting any warning messages, the intersection controller 5 transmits the traffic light control and warning information to the control center 10 at block 114. The control center 10 then updates its database at block 116. After all transmissions and broadcast have been completed, it is determined at block 117 whether the operations of the intelligent controller 5 is to continue. If it is to continue, then the controller 5 enters a time delay 118 for a period of time T before returning control to update data from traffic sensor 2. If it is not to continue, the operation of the intelligent controller 5 ends at block 119. The ability to terminate the operation of the automatic controller permits operator override, change of system parameters or other adjustment that may be needed from time to time. Other distribution of the control and calculation operations described in FIG. 10 are possible. For example, fuzzy logic calculations may be made at the traffic light controllers 5 and the results then transmitted to the central controller 10.

FIG. 11 is a diagram illustrating possible examples of various warnings that a control center 10 could transmit or broadcast at any one time to road-side warning signs. Traffic warning signs may be at fixed, permanent locations, or the individual signs may be portable. For fixed location traffic warning signs, the GPS coordinates of the sign are known. The distance and fuzzy logic calculations are made at the control center 10 or at the related traffic light controller 5 or other road-side sign based on those known locations. For movable traffic warning signs, a GPS receiver on the sign determines the location of the warning sign. Movable warning signs with real time up-date of locations using GPS provides maximum flexibility to traffic control personnel. Signs may be placed where needed. Messages may be transmitted to individual signs based on the reported sign location. Of course, the GPS coordinates may be transmitted by personnel placing the signs instead of from a GPS receiver incorporated in the sign itself. However, actual incorporation of the GPS receiver and location transmitter in the portable sign minimizes possibilities of mistakes caused by incorrect location information in the central controllers 10. Such information would be incorrect, for example, if a sign were moved and traffic control personnel failed to transmit or otherwise convey updated location information. In another embodiment, warning messages are transmitted form the central control 10 with the GPS coordinates of one or more particular problem situations. Individual road-side signs can then decide on an autonomous basis which messages to display depending on the sign location and the coordinates of the problem situation.

Similar to the control of traffic lights and warning signs, the factors involved in computing the distribution of traffic warning messages to vehicles and generation of appropriate advisory messages to drivers are complex and also require a structured and logical approach in organizing large amounts of data and information. For the same reasons as discussed above, problems of this type generally benefit from the use of expert system technology with preprogrammed decision rules based upon expert experience reflecting proper response to various situations. Various expert system approaches are possible and may be used to determine and distribute warning messages and information in systems and methods disclosed herein. Indeed, just as in the case of the traffic light phase-split controller operations described above, it is the intent that the invention described herein not be limited to any particular data analysis and organizational methods. Just as in the case of the traffic light phase-split controller, a particularly attractive method for distributing warning information and generating advisory driver warning messages is fuzzy logic. Like the phase-split controller, the complexities and range of options in the vehicle traffic warning system described herein makes fuzzy logic an ideal methodology to optimize the warning process by monitoring and analyzing the various sensor outputs according to properly weighted parameters.

Figure 12A:
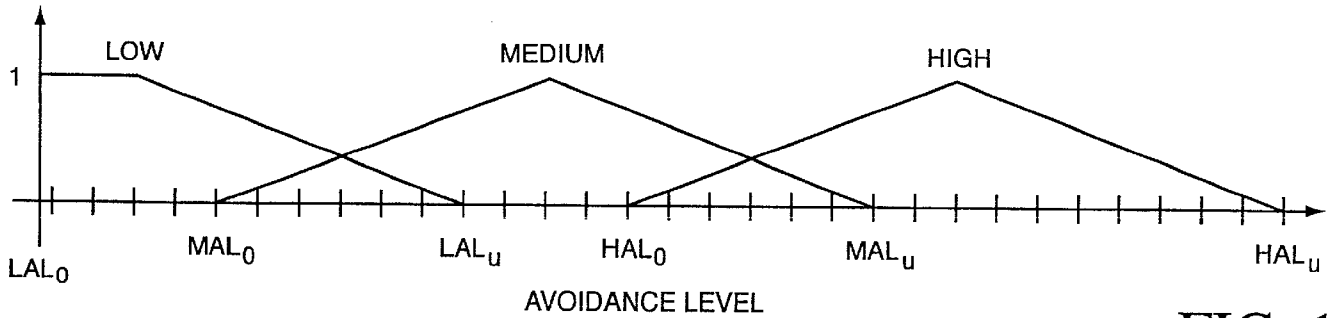
FIGS. 12A, 12B, and 12C are diagrams illustrating the fuzzy logic membership groups for the distribution of warning messages.
Figure 12B:
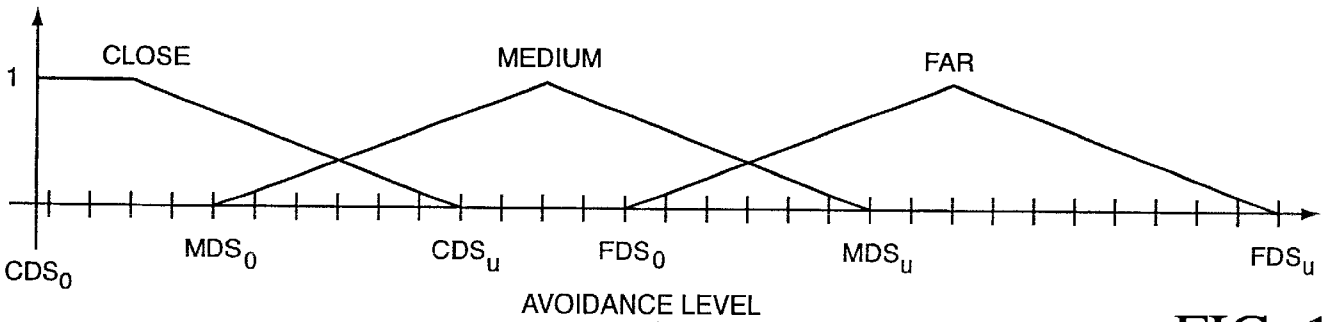
Figure 12C:
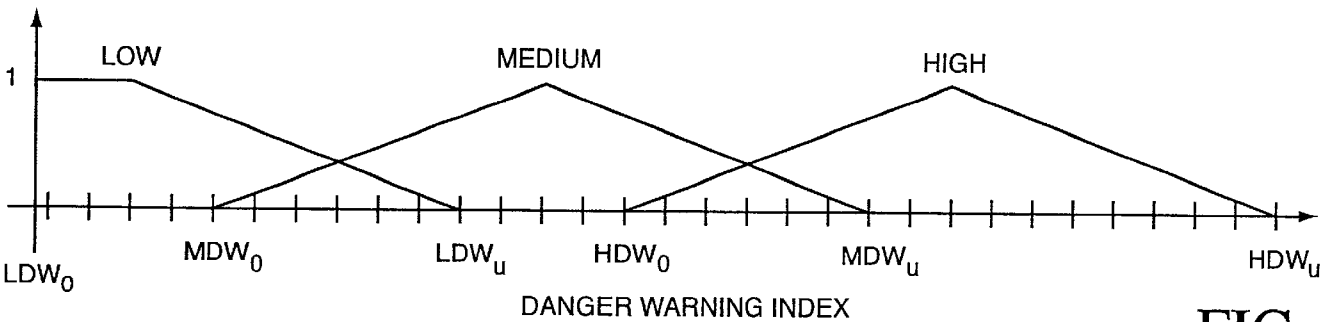

FIGS. 12A, 12B, and 12C are diagrams of three graphs illustrating the fuzzy logic memberships used by the present invention for the distribution of vehicle traffic/danger warning messages. FIG. 12A depicts the fuzzy memberships for the avoidance level (AL) associated with certain traffic/danger situations. The avoidance level is a measure of the level of danger associated with a particular traffic situation (i.e. such as a chemical spill being extremely hazardous) or the level of traffic congestion associated with the particular traffic situation (i.e. a multiple car pile-up has a high level of avoidance). FIG. 12B depicts the fuzzy memberships for the distance of a given vehicle to the traffic/danger situation of concern. FIG. 12C depicts the fuzzy memberships for the Danger Warning Index.

A preferred embodiment of the fuzzy logic controller disclosed herein is based a fuzzy reasoning system using input variables corresponding to at least Level of Avoidance, Length of Warning Radius, and Distance to Dangerous Situation. The fuzzy logic inference system generates output signals that indicate danger indices for the various vehicles in the vicinity of the dangerous situation. Vehicles receive warning signals transmitted from the central controller defining the avoidance level and GPS coordinates of the dangerous situation. The vehicle traffic warning control units 50 in the vehicles use fuzzy logic to compute the danger warning index for each vehicle.

The preferred embodiment of the fuzzy logic controller is implemented using triangular fuzzy membership functions as shown in FIGS. 12A through 12C. Other membership functions (MF's) are possible including: (1) Trapezoidal MF's, (2) Gaussian MF's, (3) Generalized Bell MF's, and (4) Sigmoidal MF's, and can easily be substituted for the trapezoidal fuzzy membership functions.

The rule base for the traffic warning system and method disclosed herein is formulated with "IF . . . THEN . . . " structures representing the linguistic expression of the logical elements involved in the fuzzy logic rule base. As shown in FIGS. 12A, 12B, and 12C, the triangular membership functions include overlapping membership ranges for the following variable ranges:

AVOIDANCE LEVEL: LOW, MEDIUM, HIGH

DISTANCE TO DANGEROUS SITUATION: CLOSE, MEDIUM, FAR

DANGER WARNING INDEX: LOW, MEDIUM, HIGH

To better understand the fuzzy logic compositional rules applied to the traffic and emergency warning distribution system and method disclosed herein, the Avoidance Level variable shown in FIG. 12A is considered. The fuzzy set corresponding to "Low Avoidance Level" (LAL) is the set of all distances D between zero avoidance level ($LAL_0$) and the upper avoidance level ($LAL_u$). Similarly, the fuzzy set corresponding to Medium Avoidance Level (MAL) is the set of all distances between the lowest defined Medium Avoidance Level ($MAL_0$) and the upper avoidance level ($MAL_u$). Because of the "fuzzy" definitions of "Low" and "Medium", it will be true that $MAL_0$ distances will be less than LALu distances ($MAL_0 < LAL_u$), and the fuzzy sets will overlap. Similarly, overlap occurs between the other defined distance ranges.

Figures 13, 14:
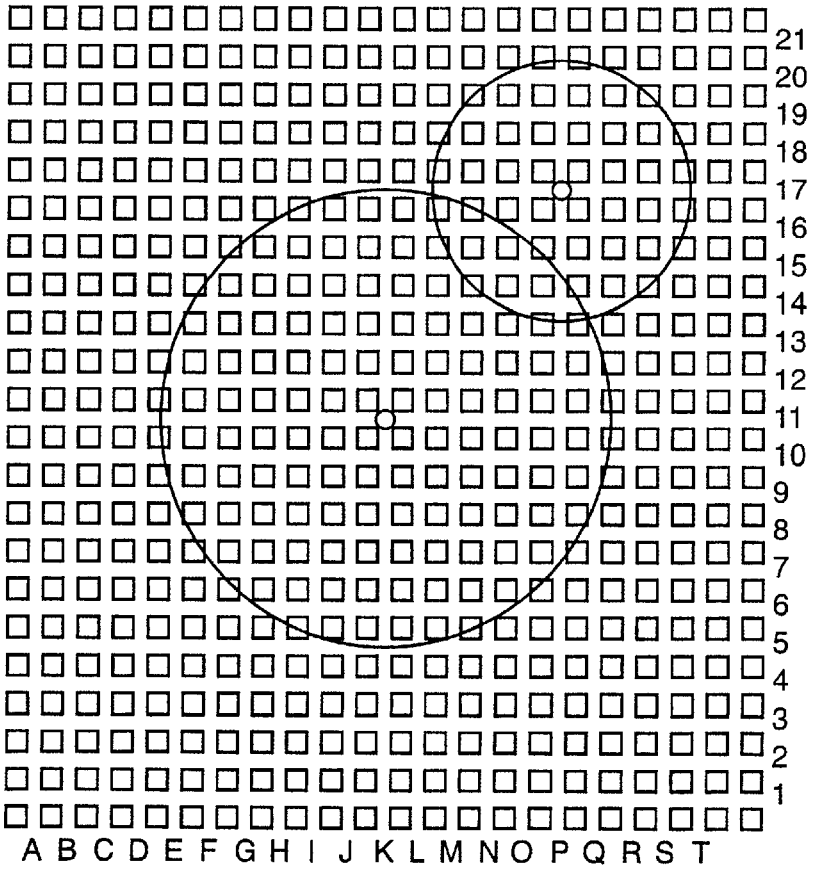
FIG. 13 is a diagram illustrating the fuzzy logic decision rules for the distribution of warning messages.
FIG. 14 is diagram illustrating different radii for the distribution of warning messages.

The nature of the overlapping membership functions for several of the variables involved in the disclosed traffic warning system and method is illustrated in FIGS. 12A, 12B and 12C. Similar relationships may exist for other variables not shown. In the fuzzy logic implementation, the two input variables (Avoidance Level and Distance to Dangerous Situation) are used to compute the Danger Warning index with the corresponding membership functions indicated in FIGS. 12A and 12B. Example fuzzy logic inference rules are shown in FIG. 13. In the example rule set shown in FIG. 13, nine fuzzy logic inference rules are indicated. For each of the values of the Danger Warning Index, various combinations of Avoidance Level and Distance are indicated. In the matrix of FIG. 13, the Avoidance Level variables are indicated in the columns while the Distance to Dangerous Situation variables are indicated in the rows of the matrix. For example, FIG. 13 shows the following:

IF Avoidance Level=Low and Distance to Dangerous Situation=Low, THEN Danger Index=Medium.

IF Avoidance Level=High and Distance to Dangerous Situation=Medium, THEN Danger Index=High.

IF Avoidance Level=Medium and Distance to Dangerous Situation=High, THEN Danger Index=Low.

It should be understood that different rules would exist if different parameters and data were considered. The examples given here are only meant to be illustrative of the possibility of organizing the information necessary to generate the danger index and dispatch control messages using fuzzy logic principles. Because of the overlapping nature of the input variables as indicated in the membership functions of FIGS. 12A, 12B, and 12C, multiples of the fuzzy logic inference rules of FIG. 13 may be "fired" for given discrete values of the input variables. The fuzzy logic inference rules of FIG. 13 are structured using the input value for each of the input variables combined with logical "AND" operators. Standard fuzzy logic methods are used to derive the correct value of the output danger index.

Some dangerous situations may call for greater radii of concern than others. For example, toxic fumes may spread over a greater area extending the region beyond that for other types of dangerous situations. The present invention accommodates such variable radii by transmitting a "radius of concern" parameter with the danger warning message. This parameter permits individual vehicle warning controller 50 (FIG. 6) and sign controller 5 (FIG. 5) to scale the actual distress corresponding to the distance variable in the fuzzy logic calculation.

An important feature of the present invention is the integration of the traffic light control operation with that of the warning sign and vehicle warning message operation. Both the traffic light phase-split control and the generation of warning messages for the signs and vehicles make common use of traffic and weather sensor information. Both use common radio transceiver capabilities, common GPS location capabilities, common distributed warning computation capabilities, common central control capabilities, and common database information. Furthermore, outputs from the traffic light fuzzy logic phase-split calculations serve as inputs to the warning message fuzzy logic calculations. For example, a congestion situation indicating an unusual phase-split at a given intersection is a factor in the "level of avoidance" variable in the warning message calculation. In this way, outputs from the first fuzzy logic calculation determining traffic light phase-splits become inputs to the second fuzzy logic concerning warning messages.

FIG. 14 is a diagram illustrating the radii of concern surrounding two traffic situations occurring simultaneously within a city's grid system of streets. FIG. 14 shows that the radius associated with the traffic/emergency situation at P Street and $17^{th}$ Street is less than the radius associated with the traffic/emergency situation at K Street and $11^{th}$ Street. In fact, there is an area within the city that is within both areas defined by the separate traffic situations. The warning signals will help to alleviate the traffic/emergency situation and aid motorists from driving to a traffic jam or dangerous situation.

In situations where traffic control is desired for an entire street, at subsequent and sequential intersections for instance, the system presented herein could be used. That is, the central controller or controllers will be used to send signals to multiple traffic signal controllers to program the flow of traffic on a street or to a grid of streets. It may use an average of the collected data on successive streets and intersecting streets. The fuzzy logic outputs may become inputs to a new calculation or be used directly. It may be used w for the control of multiple traffic lights, warning signs and other traffic control tools, for instance, lane control devices, or as a flow averaging or buffering technique to manage the flow of traffic. Such technique may result in the changing or traffic patterns in order to prevent the overloading of a particular intersection or section of consecutive or proximate intersections.

In summary, one embodiment of the invention is a method of using at least one central controller that will communicate with at least one intelligent traffic light controller and at least one other intelligent controller for controlling traffic or traffic lights and selectively distributing warning messages to motorists. The purpose of doing this is to obtain traffic information from various traffic information units and then to transmit the traffic information to the central controller. The central controller is used to determine traffic congestion parameters and determine warning information. The derived congestion and warning information are input variables to one or more fuzzy logic controllers that derive traffic light phase-split control signals. The central controller transmits traffic light phase split control information to one or more intelligent traffic light controllers which sets the traffic light phase splits for at least one traffic light. The intelligent traffic light controller may transmit a confirmation message back to the central controller. Another function of the central controller is the broadcasting of traffic warning information signals. These traffic warning information signals define the nature of at least one traffic situation to be avoided, geographic coordinates of that traffic situation and a level of avoidance indication for such identified situations. The broadcast warning information signals may be sent to and received by at least one other intelligent traffic controller. The receiving controller can also compare the coordinates of this controller with the coordinates of the situation to be avoided and compute the distance between that intelligent controller and the situation. The system will use the received level of avoidance indication and the derived distance as fuzzy variable inputs to a second fuzzy logic controller located in the receiving intelligent controller. This receiving intelligent controller can then derive a danger warning message for the particular situation to be avoided relative to the location of the receiving intelligent controller. Finally, the system, in at least one embodiment, will intelligibly indicate the danger warning message to motorists.

In an embodiment where there are warning signs that are either permanently placed or are mobile signs, an intelligent traffic controller can act as a controller for the sign. In the situation where the sign is a mobile sign, the geographical coordinates of that sign will be transmitted to the central controller and/or the traffic light controller so that the location of the sign is known. If the sign is a stationary sign, the location will be known and can be hard keyed into the database for access by the intelligent traffic light controller or the central controller.

The inventions set forth above are subject to many modifications and changes without departing from the spirit, scope or essential characteristics thereof. Thus, the embodiments explained above should be considered in all respect as being illustrative rather than restrictive of the scope of the inventions as defined in the appended claims. For example, the present invention is not limited to the specific embodiments, apparatus or methods disclosed for obtaining traffic information from various traffic information units, for transmitting traffic information, for determining congestion parameters and warning information, for transmitting the congestion parameters and the warning information, or for determining appropriate action based on the congestion parameters and the warning information. The present invention is also not limited to the use of fuzzy logic, expert systems, intelligent systems, and the corresponding embodiments, apparatuses and methods disclosed herein. The present invention is also not limited to the use of GPS communication satellites and GPS receivers to determine locations of vehicles, signs, and other such units throughout the system. The present invention is also not limited to any particular form of computer or computer algorithm. Furthermore, the present invention is not limited to the controllers, processors, sensors, signs, transmitter/receivers, antennas, microphone, speaker, camera, display, interface devices, audio/speech devices, and other such devices and components disclosed in this specification.

What is claimed is:

1. A method of using at least one central controller and at least one intelligent controller for controlling traffic and traffic lights and selectively distributing warning messages to motorists comprising the acts of:

(a) obtaining traffic information from various traffic information units, (b) transmitting the traffic information to at least one central controller, (c) using the central controller to determine congestion parameters and warning information, (d) transmitting the congestion parameters and the warning information from the at least one central controller to the intelligent controller, and (e) using the intelligent controllers to determine appropriate action based on the congestion parameters and the warning information.

2. The method according to claim 1 wherein the traffic information units are traffic lights with intelligent controllers wherein each of the traffic lights with the intelligent controllers further comprises:

(a) a computer controller including a processor and memory, (b) a receiver coupled to the computer controller wherein the receiver receives and analyzes communication signals from at least one central controller, and (c) a transmitter coupled to the computer controller wherein the transmitter generates and transmits signals to at least some of the other traffic information units.

3. The method according to claim 1 wherein the traffic information units are traffic lights with intelligent warning signs wherein each of the traffic lights with the intelligent warning signs further comprises:

(a) a receiver that receives and analyzes communication signals from at least some of the other traffic information units, and (b) a warning sign that displays the warning messages to the motorists.

4. The method according to claim 1 wherein the traffic information units are intelligent roadside warning signs wherein each of the intelligent roadside warning signs further comprises:

(a) a receiver that receives and analyzes communication signals from at least some of the other traffic information units, and (b) a warning sign that displays the warning messages to the motorists.

5. The method according to claim 1 wherein the traffic information units are traffic lights with cameras wherein the traffic lights with cameras further comprises:

(a) a camera that monitors an intersection or road, (b) a receiver that receives and analyzes communication signals from at least some of the other traffic information units, and (c) a transmitter that at least receives signals from the camera and generates and transmits signals to at least some of the other traffic information units.

6. The method according to claim 1 wherein the traffic information units are roadside traffic and weather sensors wherein each of the roadside traffic and weather sensors further comprises a transmitter that generates and transmits signals to the at least one central controller.

7. The method according to claim 1 wherein the traffic information units are vehicle warning units wherein each of the vehicle warning units further comprises:

(a) a receiver that receives and analyzes communication signals from at least one central controller, (b) a satellite receiver that receives and analyzes communications signals from a satellite positioning system and determines current geographic location of each of the warning units, (c) a transmitter that generates and transmits data to at least one central controller, and (d) an alarm indicator that indicates a relevant traffic situation or emergency.

8. The method according to claim 7 wherein the vehicle warning units are a plurality of vehicle warning units wherein each of the vehicle warning units further comprises:

(a) a receiving circuit to receive data from the at least one central controller, (b) a transmitter to transmit data to the at least one central controller, and (c) a global positioning system receiver to determine exact location of each of the vehicle warning units.

9. The method according to claim 7 wherein the intelligent central controller comprises a plurality of central controllers and wherein each of the vehicle warning units is capable of determining from which one of the plurality of central controllers it is to receive data transmission based on the current geographic location of the each of the vehicle warning units.

10. The method according to claim 1 wherein at least one controller is one of a plurality of central controllers, wherein each of the central controllers further comprises:

(a) a database computer having a database storage unit, (b) a processor and memory configured to monitor existing traffic conditions and emergency situations and distribute warning messages, (c) a receiver that receives and analyzes communication signals from the traffic information units, and (d) a transmitter that generates and transmits signals to the traffic information units.

11. The method according to claim 1 further comprises the acts of:

(a) providing a plurality of traffic light controllers, and (b) configuring the traffic light controllers to receive data from the central controller, to transmit data to the central controller, to transmit data from at least some of the traffic information units, and to receive data from the at least some of the traffic information units.

12. The method according to claim 1 further comprising the acts of:

(a) providing a plurality of traffic sensors, and (b) configuring the traffic sensors to transmit information to at least one central controller.

13. The method according to claim 1 further comprising the act of providing a plurality of roadside warning signs wherein each of the roadside warning signs includes a receiving circuit to receive data from the at least one central controller and at least some of the traffic information units and also includes global positioning system receivers to determine exact locations of the roadside warning signs.

14. The method according to claim 13 wherein the act of providing a plurality of roadside warning signs further comprises the act of providing a plurality of fixed-location roadside warning signs.

15. The method according to claim 13 wherein the act of providing a plurality of roadside warning signs further comprises the act of providing a plurality of movable roadside warning signs.

16. The method according to claim 1 further comprising the act of providing global positioning system location receivers and processors for the traffic information units located in emergency vehicles wherein the receivers and the processors precisely locate the emergency vehicles and report location, movement and destination to the at least one central controller for use in generating traffic management controls.

17. The method according to claim 1 wherein the act of using the intelligent controllers further comprises the act of using the intelligent controllers to determine appropriate traffic control action.

18. The method according to claim 1 wherein the act of using the intelligent controllers further comprises the act of using the intelligent controllers to determine appropriate traffic information distribution.

19. The method according to claim 18 wherein the traffic information is traffic warning messages.

20. The method according to claim 1 further comprising the act of integrating traffic light control operations and traffic information distribution operations in determining the appropriate action.

* * * * *